US006237251B1

(12) United States Patent
Litchfield et al.

(10) Patent No.: US 6,237,251 B1
(45) Date of Patent: May 29, 2001

(54) ATHLETIC SHOE CONSTRUCTION

(75) Inventors: Paul E. Litchfield, Westboro; Theresa S. Scalzi, Waltham; Laura K. Mount, Hull; Matthew Montross, S. Weymouth; Merrick W. Jones, Needham; Craig Feller, Duxbury; William Marvin, Boston; Robert Monahan, Canton, all of MA (US); Peter M. Foley, Minnetonka, MN (US); Steven F. Smith, Lake Oswego, OR (US)

(73) Assignee: Reebok International Ltd., Canton, MA (US)

( * ) Notice: Subject to any disclaimer, the term of this patent is extended or adjusted under 35 U.S.C. 154(b) by 0 days.

(21) Appl. No.: 09/409,747

(22) Filed: Oct. 1, 1999

Related U.S. Application Data

(63) Continuation-in-part of application No. 08/565,235, filed on Nov. 30, 1995, now abandoned, which is a continuation of application No. 08/161,610, filed on Dec. 6, 1993, now abandoned, which is a continuation-in-part of application No. 08/109,995, filed on Aug. 23, 1993, now Pat. No. 5,343,638, and application No. 07/748,079, filed on Aug. 21, 1991, now Pat. No. 5,319,866, said application No. 08/109,995, is a continuation of application No. 07/828,440, filed on Jan. 31, 1992, now abandoned.

(51) Int. Cl.[7] ..... A43B 13/00
(52) U.S. Cl. ..... 36/25 R; 36/31; 36/114
(58) Field of Search ..... 36/25 R, 91, 114, 36/31

(56) References Cited

U.S. PATENT DOCUMENTS

| | | |
|---|---|---|
| Re. 33,066 | 9/1989 | Stubblefield . |
| 180,819 | 8/1876 | Ames . |
| 634,588 | 10/1899 | Roche . |

(List continued on next page.)

FOREIGN PATENT DOCUMENTS

| | | |
|---|---|---|
| 0 352 807 A2 | 1/1990 | (EP) . |
| 2 484 215 | 12/1981 | (FR) . |
| 2 114 869 | 9/1983 | (GB) . |
| 1-164804 | 11/1989 | (JP) . |
| WO 91/16830 | 11/1991 | (WO) . |

OTHER PUBLICATIONS

Runner's World, pp. 58, 72 and unkown page (Apr. 1991).
Running Times, pp. 23 and 26 (Apr. 1991).

*Primary Examiner*—M. D. Pattterson
(74) *Attorney, Agent, or Firm*—Sterne, Kessler, Goldstein and Fox P.L.L.C.

(57) ABSTRACT

A supportive, lightweight athletic shoe construction is described which includes an inflatable upper and a sole. The upper includes a foot conforming support member, an inflatable exoskeleton and an overlay which inhibits outward bulging of the exoskeleton. The sole includes a rigid carrier element, a forefoot unit and a heel unit. The forefoot unit includes a plurality of components which are arranged to work with the biomechanics of the foot. The athletic shoe is structurally minimalistic and functionally efficient.

17 Claims, 34 Drawing Sheets

U.S. PATENT DOCUMENTS

| | | | | |
|---|---|---|---|---|
| 1,422,716 | | 7/1922 | Jones . | |
| 1,602,675 | | 10/1926 | Hurley . | |
| 1,630,445 | | 5/1927 | Murray . | |
| 1,776,750 | | 9/1930 | Burns . | |
| 2,001,821 | | 5/1935 | Everston . | |
| 2,070,116 | | 2/1937 | Cutillo . | |
| 2,147,197 | | 2/1939 | Glidden . | |
| 2,275,720 | | 3/1942 | Bingham, Jr. . | |
| 2,325,639 | | 8/1943 | Stritter . | |
| 2,678,506 | | 5/1954 | Baroumes . | |
| 2,698,490 | | 1/1955 | Goldman . | |
| 3,586,003 | | 6/1971 | Baker . | |
| 4,078,322 | | 3/1978 | Dalebout . | |
| 4,316,334 | | 2/1982 | Hunt . | |
| 4,335,530 | | 6/1982 | Stubbelfield . | |
| 4,398,357 | | 8/1983 | Batra . | |
| 4,399,621 | | 8/1983 | Dassler . | |
| 4,439,937 | | 4/1984 | Daswick . | |
| 4,454,662 | | 6/1984 | Stubblefield . | |
| 4,485,568 | * | 12/1984 | Landi et al. | 36/28 |
| 4,490,928 | | 1/1985 | Kawashima . | |
| 4,541,186 | | 9/1985 | Mulvihill . | |
| 4,542,598 | | 9/1985 | Misevich et al. . | |
| 4,546,559 | | 10/1985 | Dassler . | |
| 4,547,979 | | 10/1985 | Harada et al. . | |
| 4,550,510 | * | 11/1985 | Stubblefield | 36/114 |
| 4,578,883 | | 4/1986 | Dassler . | |
| 4,641,438 | | 2/1987 | Laird et al. . | |
| 4,642,917 | | 2/1987 | Ungar . | |
| 4,651,445 | | 3/1987 | Hannibal . | |
| 4,676,010 | | 6/1987 | Cheskin . | |
| 4,694,591 | | 9/1987 | Banich et al. . | |
| 4,771,554 | | 9/1988 | Hannemann . | |
| 4,854,057 | | 8/1989 | Misevich et al. . | |
| 4,878,300 | | 11/1989 | Bogaty . | |
| 4,922,631 | | 5/1990 | Anderie . | |
| 5,052,130 | * | 10/1991 | Barry et al. | 36/114 |
| 5,131,173 | * | 7/1992 | Anderie | 36/114 |
| 5,185,943 | | 2/1993 | Tong et al. . | |
| 5,191,727 | | 3/1993 | Barry et al. . | |
| 5,317,819 | | 6/1994 | Ellis, III . | |
| 5,319,866 | * | 6/1994 | Foley et al. | 36/31 |
| 5,381,607 | * | 1/1995 | Sussmann | 36/30 R |
| 5,390,430 | | 2/1995 | Fitchmun et al. . | |
| 5,544,429 | * | 8/1996 | Ellis, III | 36/31 |
| 5,829,172 | * | 11/1998 | Kaneko | 36/108 |
| 5,832,634 | * | 11/1998 | Wong | 36/31 |
| 5,915,820 | * | 6/1999 | Kraeuter et al. | 36/114 |

* cited by examiner

ATHLETIC SHOE CONSTRUCTION

CROSS REFERENCE TO RELATED APPLICATIONS

This application is a continuation-in-part of U.S. application Ser. No. 08/565,235 filed Nov. 30, 1995, now abandoned which is a continuation of U.S. application Ser. No. 08/161,610 filed Dec. 6, 1993, now abandoned which is a continuation-in-part of U.S. application Ser. No. 08/109,995 filed Aug. 23, 1993, now U.S. Pat. No. 5,343,638, and application Ser. No. 07/748,079 filed Aug. 21, 1991, now U.S. Pat. No. 5,319,866. U.S. application Ser. No. 08/109,995 is a continuation of application Ser. No. 07/828,440 filed Jan. 31, 1992, now abandoned.

BACKGROUND OF THE INVENTION

1. Field of the Invention

The present invention relates generally to an athletic shoe and more particularly to an athletic shoe construction which is lightweight and supportive.

2. Related Art

As a result of the public's renewed interest in physical activity, increased attention has been given to the development of athletic footwear. Many of the recent developments in athletic footwear relate to either the fit, function, or weight of the shoe. Oftentimes, however, it is difficult to improve the fit or function of the shoe without increasing the total weight of the shoe. Thus, it has become an objective of footwear manufacturers to develop an athletic shoe which is supportive and comfortable, yet lightweight.

Typically, an athletic shoe includes an upper and a sole. The upper is that part of the shoe which covers and protects the heel, instep, toe and side portions of the foot. The upper is secured to the wearer's foot by a closure system which typically includes a lacing means, buckles, or hook and loop-type fasteners, such as VELCRO® fasteners. The closure system of the upper is conventionally positioned above the instep portion of the foot to allow easy donning and doffing of the shoe.

The sole of an athletic shoe includes an insole, a midsole, and an outsole. The insole (or insole board) lies next to the foot under a sockliner. The insole is the foundation of the shoe to which the upper is lasted and the sole attached.

The midsole lies between the insole and the outsole. The primary function of the midsole is to provide cushioning to the wearer's foot, specifically in the heel and forefoot regions. The midsole may be formed in one or more pieces and often includes a wedge or cushioning insert disposed beneath the heel of the wearer to effectively increase the amount of cushioning. A mechanism for stabilizing the heel of the foot may also be incorporated into the midsole.

The outsole is that part of the shoe which comes into direct contact with the ground. The outsole is commonly molded from an abrasive resistant material such as rubber. The standard sole unit, consisting of the insole, midsole and outsole, accounts for approximately 50–62% of total shoe weight.

In an effort to reduce the weight of an athletic shoe, footwear manufacturers have attempted to remove various support or cushioning elements from the shoe. The removal of such elements, however, compromises the structural integrity and performance of the shoe. Thus, to significantly reduce the total weight of the shoe, the components thereof need to be structured in a minimalistic manner from materials which are functionally efficient. The present invention reduces the total weight of the shoe by utilizing an inflatable exoskeleton in the upper and a lightweight, yet supportive arch support in the sole. Such an arch support in the sole eliminates the need for cushioning or abrasive resistant materials in the arch area of the shoe. The upper and sole components of the athletic shoe of the present invention are doubly efficient in that they may be applied to a variety of athletic shoe lasts including, but not limited to, basketball shoe lasts, tennis shoe lasts, and walking shoe lasts.

SUMMARY OF THE INVENTION

In accordance with the objectives and purposes of the present invention as embodied and described herein, the present invention is an athletic shoe comprising a lightweight upper and a lightweight sole.

In one aspect, the present invention is an upper for an athletic shoe having a foot conforming support member, an inflatable exoskeleton attached to the foot conforming support member and an overlay positioned over the inflatable exoskeleton to inhibit outward bulging of the inflatable exoskeleton away from the surface of a wearer's foot. The inflatable exoskeleton includes two thin films which are bonded along their peripheral edges to form at least one fluid impervious compartment. The upper may include an on-board pump. The pump may be positioned on a tab positioned on the heel of the shoe.

In another aspect, the present invention is an upper for an athletic shoe which includes a support member which surrounds the upper portion of the wearer's foot and an inflatable chamber. The inflatable chamber forms an outermost surface of the upper and is formed in accordance with a pattern which defines a plurality of fluidly connected compartments which are substantially symmetrical about a central axis. The symmetrical portions of the chamber are joined to each other by a strapping system which overlies the instep and Achilles tendon of the wearer's foot. The inflatable chamber of the upper may be applied to a variety of types of athletic shoes without varying the configuration of the compartments of the inflatable chamber. The inflatable chamber of the invention may be formed from two substantially flat films and it may include an inflation mechanism and a fluid release mechanism. The pattern of the inflatable chamber may define substantially symmetrical rearfoot compartments, lower quarter compartments, ankle collar compartments and instep compartments. The rearfoot compartments (which include the ankle collar compartments) and the instep compartments may be separated by areas devoid of material to allow the chamber to be applied to an athletic shoe last of any configuration. The fluid release mechanism may include a cover which acts as a connector for coupling an off-board inflation mechanism to the inflatable chamber.

In yet another aspect of the invention, the upper of the athletic shoe includes a first component and a second component. The second component is attached to the exterior of the first component such that the second component forms an outermost surface of the upper. The second component comprises an inflatable chamber which includes a lateral midfoot compartment and a medial midfoot compartment. The lateral and medial midfoot compartments are separated from each other at the mid and lower portions thereof and joined to each other at the upper portions thereof by a tongue compartment which is in fluid communication with the lateral and medial midfoot compartments. The first component of the invention may be a support member which conforms to the upper portion of a wearer's foot.

In yet another aspect, the present invention is an athletic shoe kit including an athletic shoe comprising an upper, a sole, an inflatable chamber attached to the exterior of the upper, and a hand-held inflation mechanism. The inflation mechanism includes a source of pressurized gas for inflating the chamber of the shoe.

In still another aspect of the invention, the athletic shoe includes an upper and a sole. The sole includes a forefoot component which includes a cushioning material and an abrasive resistant material and a heel component which includes a cushioning material and an abrasive resistant material. The sole also includes an arch region which includes a rigid arch support positioned beneath the arch of the wearer and extending from the lateral edge of the shoe to the medial edge of the shoe. The arch is positioned between the forefoot component and the heel component such that the arch region is devoid of either the cushioning material or the abrasive resistant material of the sole.

The arch support may have a thickness of less than 50/1000 inch. The arch support may be a composite formed from carbon and glass. The arch support may be coated with an epoxy resin.

The present invention may also take the form of an athletic shoe having an upper and a sole. The sole includes a rigid carrier element, a forefoot unit mounted to the carrier element in the forefoot region and a heel unit mounted to the carrier element in the heel region. The forefoot unit comprises a toe component, a medial component and two lateral components. The carrier element may be formed from a carbon glass composite or a sheet of honeycomb material. The carrier element may comprise a heel stabilizer and an arch support.

BRIEF DESCRIPTION OF THE FIGURES

Various objects, features and attendant advantages of the present invention will be more fully appreciated as the same becomes better understood from the following detailed description of the present invention when considered in conjunction with the accompanying drawings, in which.

DETAILED DESCRIPTION OF THE PREFERRED EMBODIMENTS

I. The Athletic Shoe of FIGS. 1–30

Figure 1:
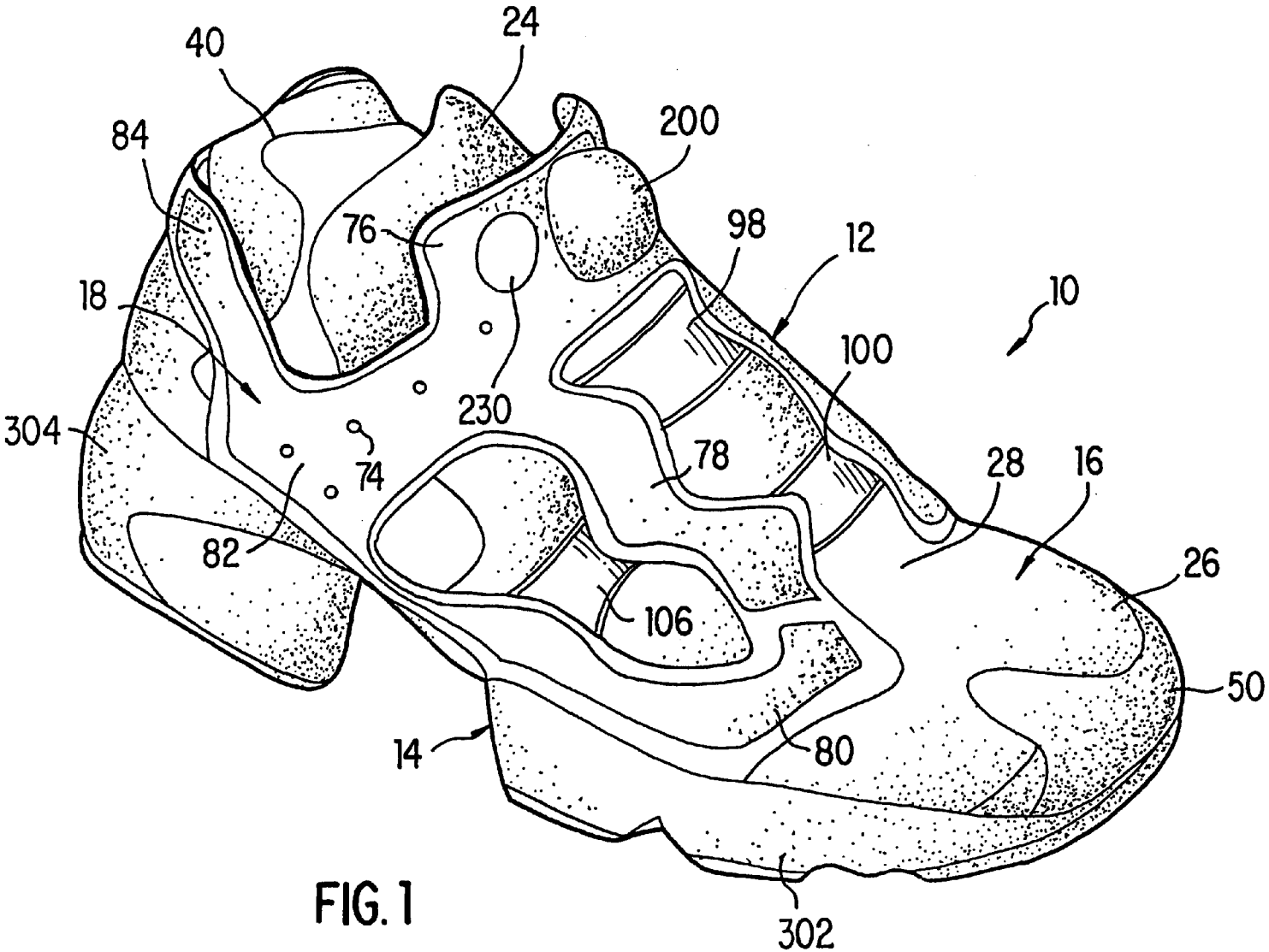
FIG. 1 is a perspective view of the lateral side of the athletic shoe of the present invention.

Referring to the accompanying drawings wherein like reference numbers indicate similar elements, the athletic shoe of the present invention is shown generally at 10 in FIG. 1. Although FIG. 1 depicts a shoe for use on the right foot of a wearer, the principles of the present invention are equally applicable to shoes intended for use on the left foot. In addition, while the following description of the preferred embodiment is specifically directed toward athletic shoes (particularly running shoes), it is anticipated that the invention be adapted for use with footwear other than those types specifically mentioned herein.

Figure 2:
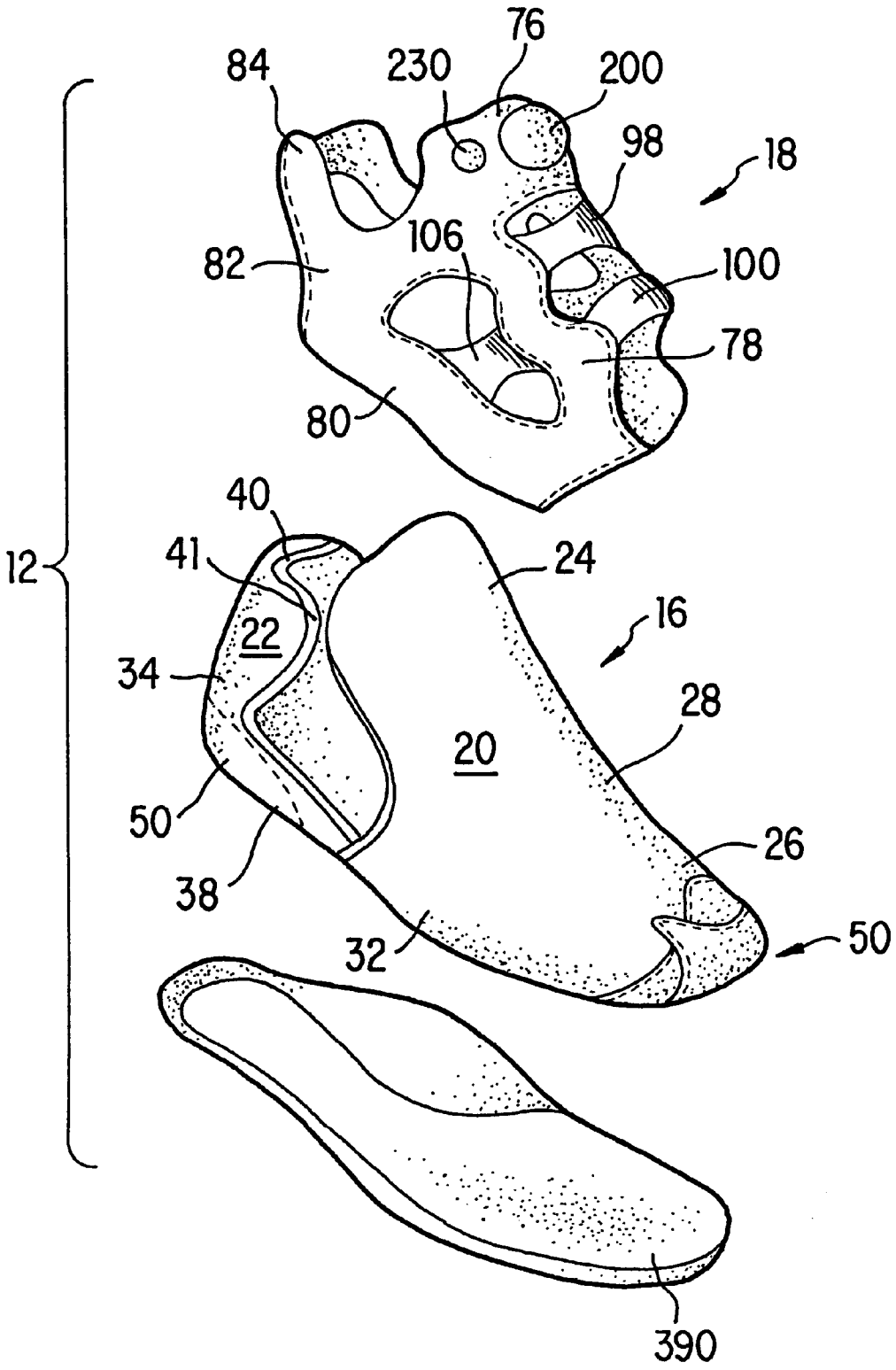
FIG. 2 is an exploded view of the upper of the athletic shoe shown in FIG. 1.

With reference now to FIGS. 1 and 2, athletic shoe 10 includes an upper 12 which surrounds the side and instep portions of the foot and a sole 14. Sole 14 underlies and generally follows the outer profile of the sole of the foot to provide protection, cushioning, and support to the same. The upper and sole of the present invention are separately discussed in detail below.

A. The Upper

Upper 12 takes a radical departure from conventional shoe uppers by providing an inflatable exoskeleton over a close-fitting, stretchable support member. The inflatable exoskeleton of the invention allows the wearer to customize the amount of support afforded by the upper to the foot, while contributing little to the total weight of the shoe. Additionally, because the foot conforming support member and inflatable exoskeleton work in conjunction to support and protect the upper of the foot, conventional upper components (such as support bands, eyestays, etc.) are eliminated to further decrease the total weight of the shoe. As illustrated most clearly in FIGS. 1 and 2, upper 12 comprises a foot conforming support member 16 and an inflatable chamber 18, a detailed description of which is provided below.

1. The Foot Conforming Support Member

Foot conforming support member 16 closely conforms to the contours of the upper portion of the foot. When fully assembled, foot conforming support member 16 functions to maintain the shoe on the wearer's foot without the need of a conventional lacing or fastening means. In addition, foot conforming support member 16 provides a mounting platform for the inflatable chamber of the present invention.

Figure 3:
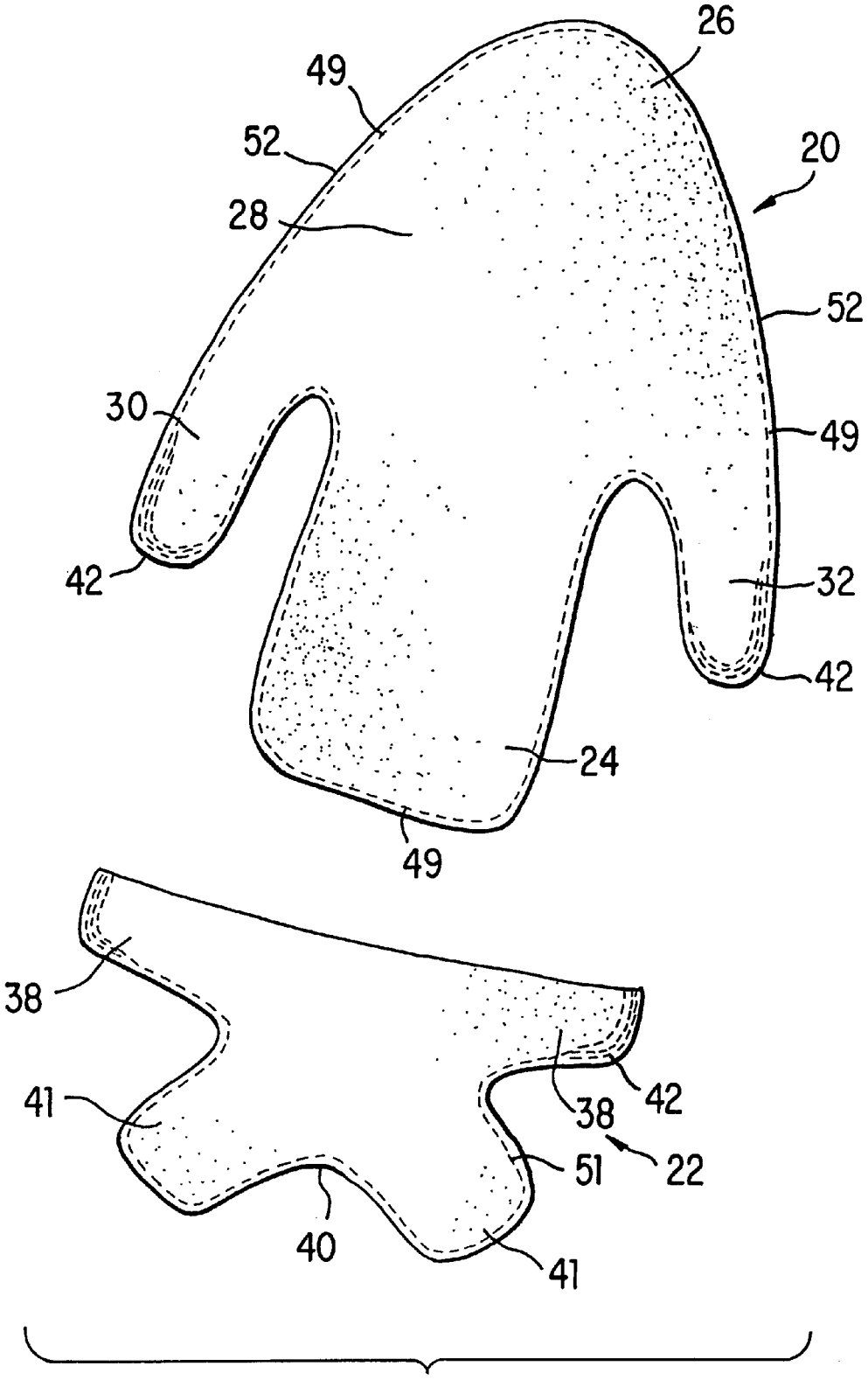
FIG. 3 is a top plan view of the pattern pieces which form the foot conforming support member of the invention.

As shown in FIGS. 2 and 3, foot conforming support member 16 is preferably formed from a two-piece pattern consisting of a forefoot piece 20 and a heel piece 22. Forefoot piece 20 is shaped to define a tongue 24, a toe 26, and a vamp 28. At its sides, vamp 28 includes a medial wing 30 and a lateral wing 32. Heel piece 22 is configured to define a counter portion 34, a medial quarter extension 36, and a lateral quarter extension 38. The free end of counter portion 34 is notched, as at 40, to accommodate the achilles tendon of the heel. Spanning from notch 40 are two projections 41 which form a collar for supporting the ankle portion of the wearer's foot.

Figure 4:
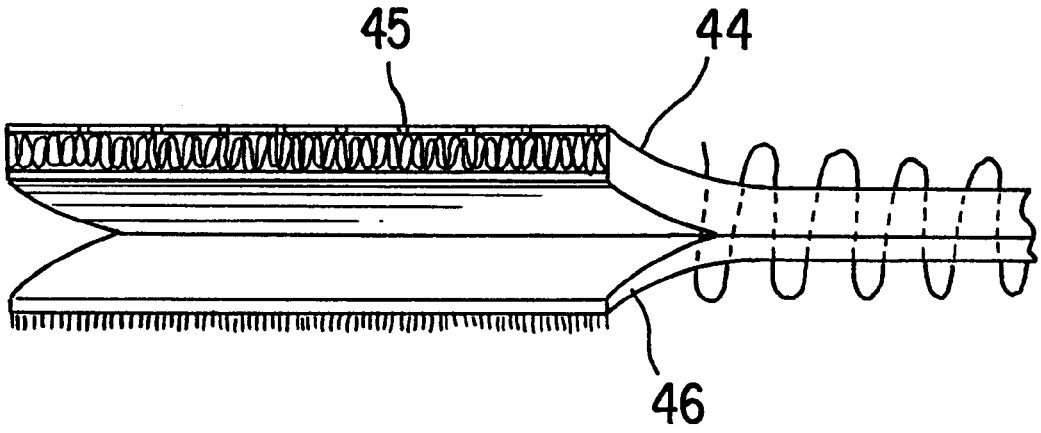
FIG. 4 is an enlarged view of the materials used to form the foot conforming support member.

With reference to FIG. 4, forefoot and heel pieces 20 and 22 are each formed by stitching a first material 44 to a second material 46. When pattern pieces 20 and 22 are fully constructed, first material 44 forms the outermost layer of the pattern pieces, while second material 46 forms the innermost layer. First material 44 is preferably a lightweight breathable material, such as COOL MESH™ (a stretchable nylon mesh having aeration holes 45) available from Dae Woo Textiles Industries. Naturally, first material 44 may be any other material which exhibits the desired characteristics mentioned above.

Second material 46 is preferably a soft, brushed nylon or polyester, or any other material which is comfortable against the user's foot, yet durable enough to withstand any friction created by movement of the wearer's foot.

Figure 4A:
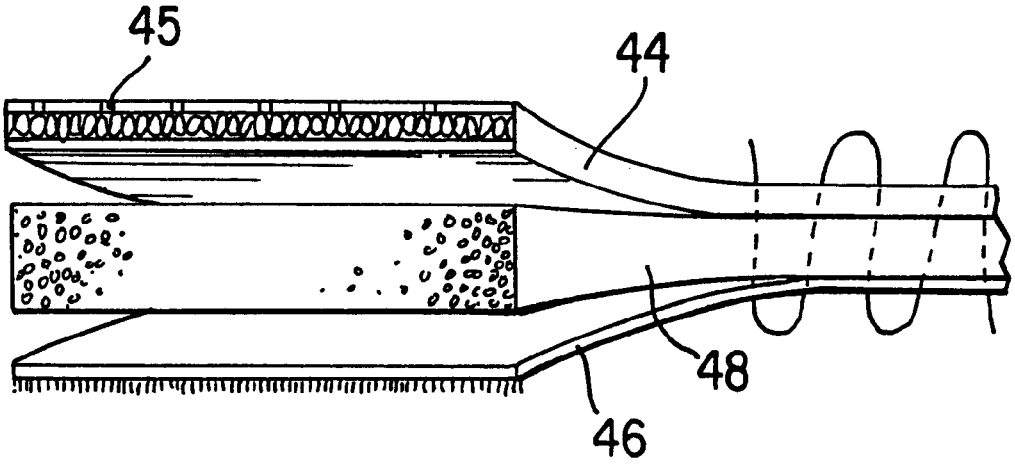
FIG. 4*a* is an enlarged view of the materials shown in FIG. 4 with the addition of a third material.

Construction of forefoot piece 20 will now be described. After cutting identical forefoot pieces from first material 44 and second material 46, the two pieces are placed in a fact-to-face relationship such that the brushed side of second material 46 faces the aerated side of first material 44. A third layer 48 is incorporated into the tongue and wing areas of the forefoot piece to provide added cushioning to those regions of the upper. With reference to FIG. 4*a,* third layer 48 is a conventional open-celled cushioning foam. Third layer 48 should be at least 2 mm thick to provide an ample amount of cushioning to the noted areas. Third layer 48 is securingly attached to the wrong side of either first material 44 or second material 46 to form a unitary two-ply fabric. The two forefoot pattern pieces are then stitched together along a seam 49 to form a complete three-layered forefoot piece. The forefoot piece is then turned right-side out by pushing tongue portion 24 through an opening located at the toe end of the forefoot pattern. The opening is then closed by stitching across the forward edge opening. If desired, a wicking material or powder may be incorporated into forefoot piece 20 to wick moisture to the outermost layer of foot conforming support member 16.

In the preferred embodiment, a toe cap 50 is stitched to the end of toe 26 to provide extra reinforcement to that region of the upper (see FIG. 2). Toe cap 50 is preferably a two-piece unit cut from leather, suede, brushed nylon, felt or any other abrasion resistant material. Toe cap 50 could also be formed from vulcanized rubber. Naturally, toe cap 50 may take a shape or configuration other than that specifically illustrated in FIG. 2.

With reference again to FIG. 3, heel piece 24 is constructed similar to forefoot piece 20 by cutting identical heel pattern pieces from first material 44 and second material 46. A third layer of foam 48 which has been cut to correspond to the heel and collar regions of the pattern is attached to the wrong side of either first material 44 or second material 46 to provide added cushioning to those areas of the upper. The heel pattern pieces are then stitched together in a wrong side out configuration along a seam 51 to form a unitary heel piece 24. The heel piece is turned right-side out by pushing counter portion 34 through an opening provided at the lower edge of the counter portion. At this time, a u-shaped heel counter 50 (shown in phantom in FIG. 2) is placed in between the first and second pattern pieces through the previously mentioned opening. Heel counter 50 provides added stability to the heel portion of shoe 10 by preventing the user's foot from pronating during heel strike. Heel counter 50 is preferably molded from polyvinyl chloride. However, heel counter 50 may be formed from any other rigid material which may be molded to a particular specification. With the heel counter properly positioned, heel piece 24 is finished by stitching across the opening and through the edge of the heel counter to close the opening and permanently secure the counter within the heel piece 24.

After constructing the forefoot and heel pieces, the foot conforming support member is assembled by stitching medial wing 30 to medial quarter extension 36 and lateral wing 32 to lateral quarter extension 38 along corresponding attachment margins 42. A partial slip sock (not shown) is then stitched to lasting margin 52 of forefoot piece 20 to complete assembly of the foot conforming support member. At this point, the foot conforming support member is now ready to be joined to inflatable chamber 18 of the present invention. Although foot conforming support member 16 has been described as being formed from a two-piece pattern, it may, of course, be formed from a one-piece or other multiple-piece pattern which may be configured in a manner other than that shown in FIG. 3.

2. The Inflatable Chamber

As mentioned briefly above, inflatable chamber 18 forms a supportive exoskeleton for the upper of athletic shoe 10. Although inflatable chamber 18 is the primary customization element of the upper, it accounts for only a small percentage of total shoe weight. Inflatable chamber 18 is unique in that its configuration allows it to be applied to a variety of athletic shoe lasts without significant modification.

Inflatable chamber 18 includes a number of component parts which include, among other things, an on-board inflation mechanism 200 and a fluid release mechanism 230. The inflation and fluid release mechanisms of the invention are permanently attached to the exterior of the chamber to control the amount of fluid entering and exiting the chamber. Detailed descriptions of the inflation and fluid release mechanisms are provided in more detail below.

Figure 5:
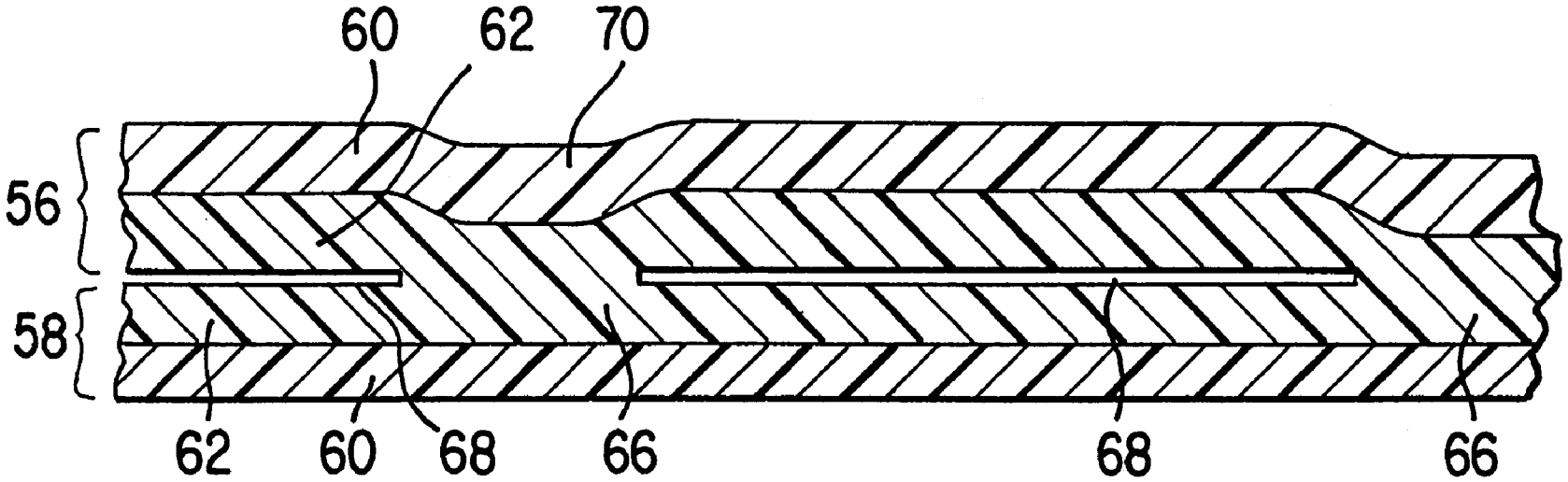
FIG. 5 is a cross-sectional view of the inflatable chamber of the present invention.

As shown in FIG. 5, inflatable chamber 18 is comprised of a first laminate 56 and a second laminate 58. Laminates 56 and 58 are formed from a first lamina 60 and a coextensive second lamina 62. For laminate 56, first lamina 60 forms the outermost layer of the chamber. Therefore, the material used to the form the first lamina must be durable (as it will be exposed to the exterior of the shoe), lightweight, and stretchable. In the preferred embodiment, the first lamina which forms the outermost surface of the chamber is a nylon fabric manufactured by Cramerton Automotive Products, L.P. under product no. 1131. This product has a stretch of approximately 35–40% in the X-Y direction to support and control outward expansion or bulging of the inflatable chamber when the same is inflated.

The first lamina 60 of laminate 58 (that which lies next to the foot conforming support member) is a nylon fabric manufactured by Adele Knits under products nos. 9968 or 8829. This fabric has a slightly higher amount of stretch so that the chamber may expand inward when inflated to snugly conform to the wearer's foot. Naturally, any other stretchable, lightweight material (such as a synthetic leather) may be used to form first lamina 60 so long as the outermost first lamina is more resistant to stretch than the innermost first lamina.

Second lamina 62 forms the innermost layers of the chamber and is preferably a fluid impervious elastic material, such as thermal-polyurethane (TPU). A suitable TPU is manufactured by Dow Chemical Company under the trademark PELLETHANE, product number 2255. In the preferred embodiment, second lamina 62 is preferably 12 mils thick, although the thickness of the second lamina may range from approximately 10 mils to 15 mils (10/1000 to 15/1000 inch). In areas of the foot where more support or rigidity is required (e.g., the rearfoot region), the thickness of second lamina 62 may be increased to approximately 14 mils. Additional rigidity may be provided by embedding polyester (or monoester) filaments into second lamina 62. Laminates 56 and 58 are formed by laminating first lamina 60 to second lamina 62 using a tri-helical lamination technique. The tri-helical lamination technique involves providing elastic second lamina 62 with a series of diagonal grooves for adhesion purposes. The first and second laminates are formed by feeding a flat sheet of thermal-polyurethane (second lamina 62) through two rollers, one of which is grooved with approximately 25 grooves per inch. As the sheet is fed through the rollers, the grooved roller embosses a series of diagonal lines across the width of the TPU sheet. These diagonal lines provide a bond which is highly resistant to flex failure. After applying a suitable amount of adhesive to second lamina 62, the second lamina is fed together with the first lamina through a second set of rollers to permanently adhere the first lamina to the second lamina. The finished laminate is then placed aside and allowed to cure at room temperature for approximately 24 hours. The tri-helical lamination technique is preferable over other non-continuous lamination techniques, as it provides a bond of high integrity without impairing the flexibility or stretch characteristics of the laminate.

After curing, the first and second laminates are placed on top of each other such that the TPU layers 62 are in a facing relationship. The inflatable chamber is formed by joining the first and second laminates together by application of radio frequency (rf) energy. (Obviously, any other means of permanently attaching the first and second laminates together is suitable for the purposes of the invention, e.g. a heated die). The laminates are attached in accordance with the pattern for inflatable chamber 18 shown in FIG. 6. The configuration of the chamber pattern is critical to achieving the objectives of the present invention. Chamber 18 defines a plurality of supportive compartments which are necessary for supporting the foot during many types of athletic activity. As such, chamber 18 may be effectively applied to athletic shoe lasts of various configurations.

Figure 6:
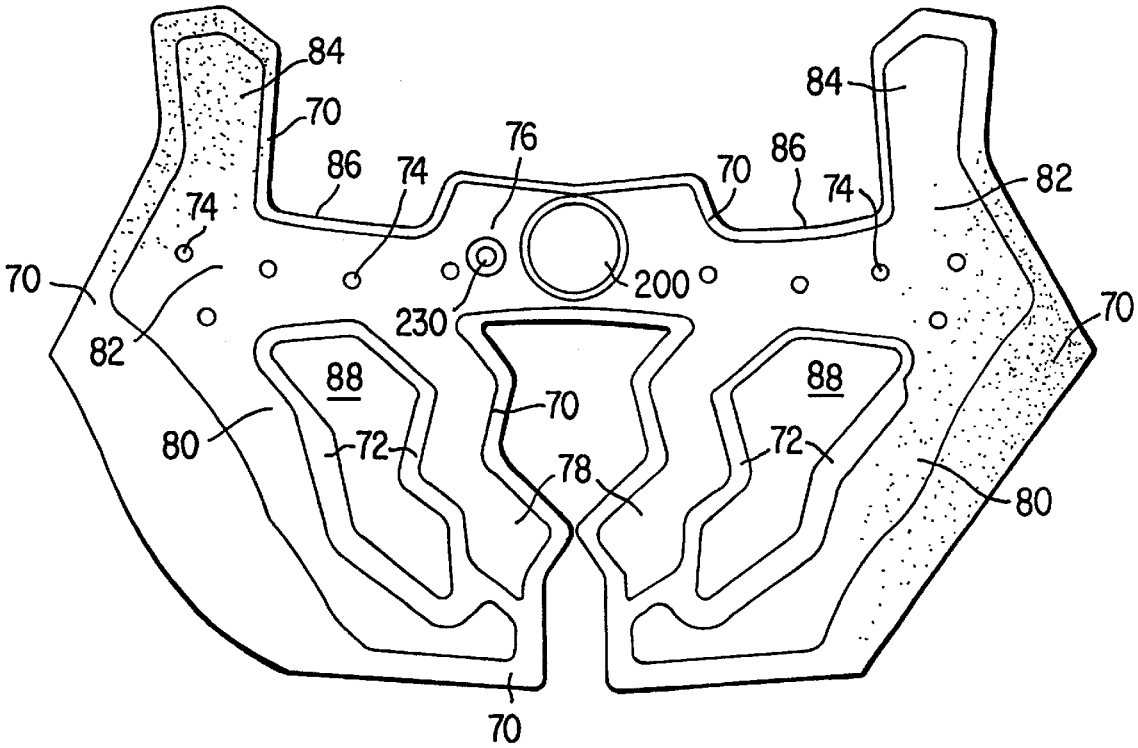
FIG. 6 is a top plan view of the inflatable chamber.
Figure 7:
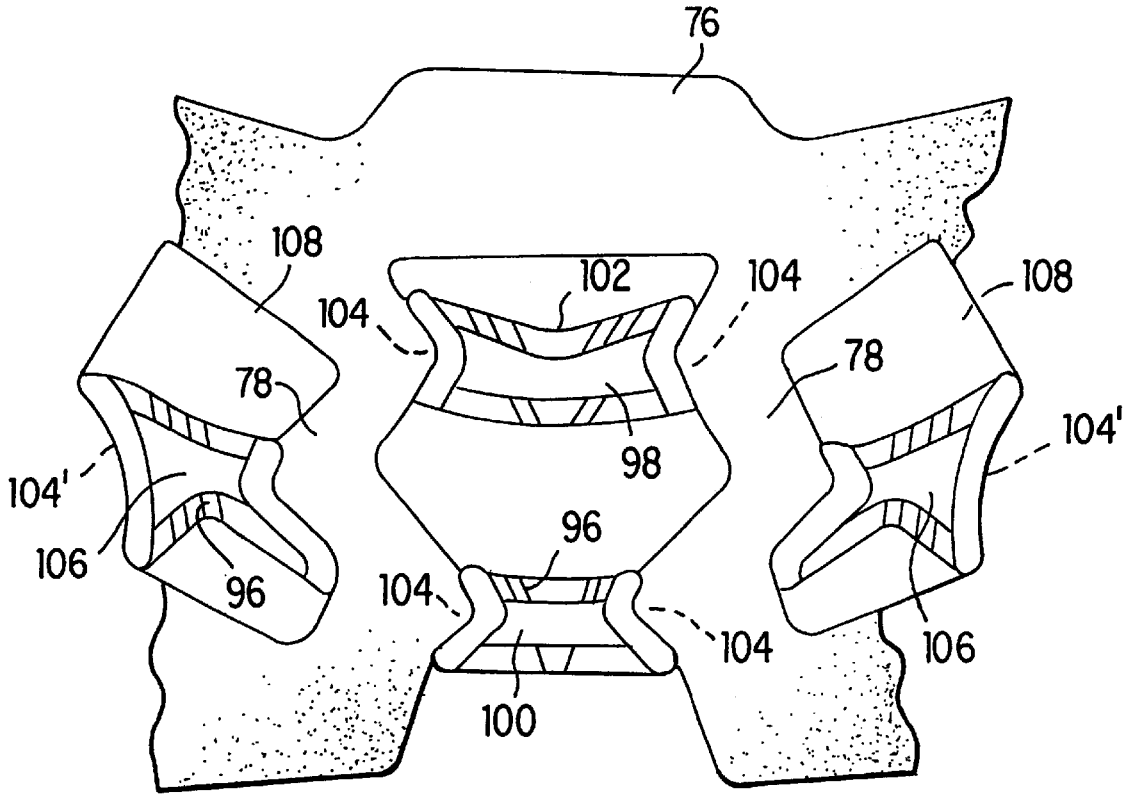
FIG. 7 is a top plan view of the strapping system of the inflatable chamber.
Figure 9:
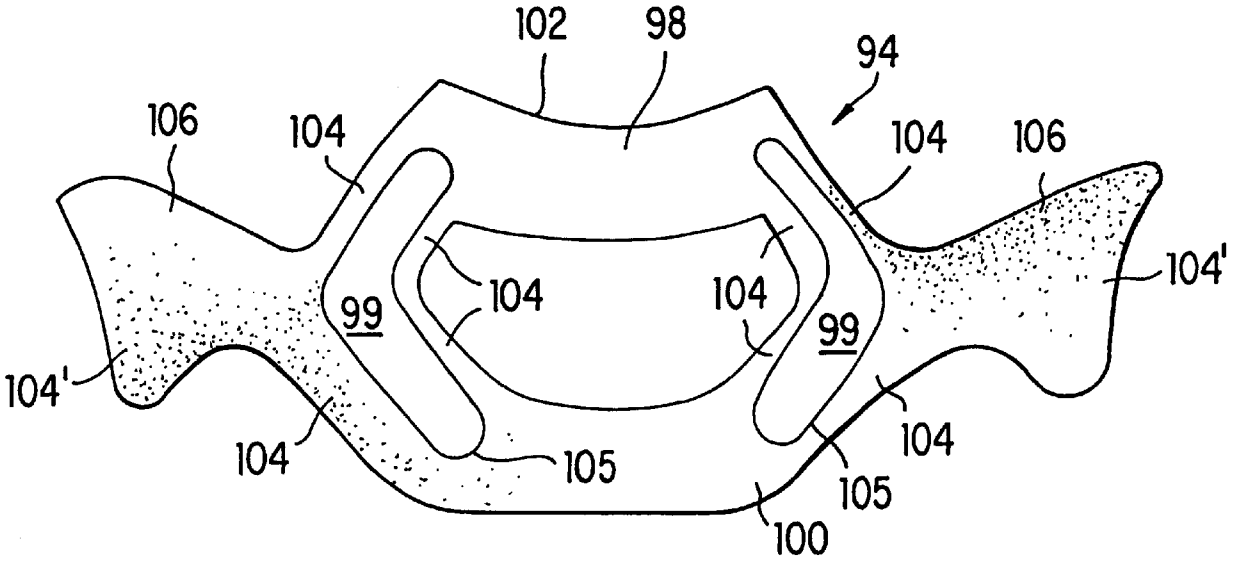
FIG. 9 is a top plan view of the pattern used to construct the strapping system shown in FIG. 7.

With reference now to FIG. 6, first and second laminates 56 and 58 are initially joined along a peripheral weld line 70 to define the exterior boundary of the chamber. A portion of this weld line eventually forms the lasting margin for attaching inflatable chamber 18 to the remainder of athletic shoe 10, the process of which will be described in more detail below. An interior weld line 72 is also applied at selected areas interior of peripheral weld line 70 to further attach the two laminates together and to define the various compartments of the inflatable chamber. As FIG. 5 illustrates, where the first and second laminates are welded together (as at 70), the TPU layers of the laminates bond or fuse to form a fluid impervious barrier 66. Where the laminates are not welded, a passageway 68 is formed which inflates when fluid is introduced into chamber 18. Thus, fluid introduced into chamber 18 is prevented from escaping therefrom by weld lines 70 and 72.

With reference again to FIG. 6, a plurality of circular welds 74 are also provided to control the thickness of the chamber in a particular region. It is preferred that, when inflated, chamber 18 be no more than 10 millimeters thick to prevent "bubbling" which could cause discomfort to the foot of the wearer. For example, in regions of the upper where it is desirable to limit the thickness of the bladder (for example, in the rearfoot region of the shoe) a number of circular welds may be provided to limit inflation of the chamber in that particular area. Furthermore, circular welds 74 should be placed so that they coincide with the bones and muscles of the foot to provide maximum comfort and support to the foot of the wearer. For example, as shown in FIG. 6, the density of circular welds 74 in compartments 82 is high, as this is a particularly large area of the chamber which would bulge excessively when inflated and cause discomfort to the area of the wearer's foot below the lateral and medial malleolus.

After welding the chamber pattern onto first and second laminates 56, 58, the attached laminates are die cut just along the edges of weld lines 70 and 72 to complete formation of inflatable chamber 18. When appropriately welded and die cut, a substantially symmetrical inflatable chamber 18 is created which includes an upper tongue compartment 76, instep compartments 78, lower quarter compartments 80, rearfoot compartments 82, and ankle collar compartments 84. Instep compartments 78 are minimalistic in nature in that the compartments run only along the medial and lateral edge of the instep. Although the mid-section of the instep is devoid of inflatable support, the lateral and medial instep compartments effectively push the foot to the rear of the shoe and into the heel counter to provide a secure fit. Similarly, the ankle collar compartments hug the foot about the sides of the achilles tendon to maintain the heel within the interior of the shoe. The rearfoot and lower quarter compartments provide support to the rear and side portions of the shoe to fill in any remaining gaps between the wearer's foot and the shoe. Thus, all of the compartments work together to securely fit the upper of the shoe about the wearer's foot. In addition, because the two instep compartments and the two rearfoot compartments are not connected, the strapping system of the invention (to be discussed in more detail below) may be used to effectively fit the inflatable chamber to a variety of athletic shoe lasts.

In areas of the foot where inflatable support is not needed, inflatable chamber 18 is notched or devoid of material to accommodate the structure of the foot and decrease the weight of the chamber. For example, inflatable chamber is notched at 86 to comfortably accommodate the lateral and medial malleolus of the foot. Additionally, chamber 18 is devoid of material in the saddle 88 and around the heel bone, as inflatable support is not needed in those particular areas of the upper.

Because all of the compartments are in fluid communication with each other, an inflating fluid need only be introduced into a single area of chamber 18 to inflate all of the compartments thereof.

Although inflatable chamber 18 has been described as being formed from two laminates, it should be noted that the chamber may be formed from only two substantially flat elastic films (such as those used to form second lamina 62).

Figure 8:
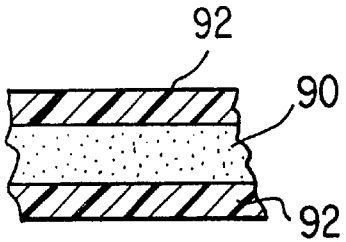
FIG. 8 is a cross-sectional view of the straps of the inflatable chamber.

Construction of inflatable chamber 18 is completed by attaching a strapping system to chamber 18. As shown most clearly in FIG. 7, a plurality of straps are provided to draw the upper about the instep portion of the foot to replace a conventional lacing or fastening system. As illustrated in FIG. 8, the straps of the invention are formed by sandwiching an interior layer 90 between two cover layers 92. Interior layer 90 is preferably formed from NEOPRENE™. However, any other material which may be comfortably stretched about the wearer's instep, yet capable of returning to its original shape after numerous stresses may be used to form interior layer 90. Provided on both sides of interior layer 90 is a cover fabric 92. Cover fabric 92 is preferably LYCRA™, a stretch spandex fabric available from E.I. DuPont de Nemours, or any other material which is durable and capable of stretching with the interior layer of the strap. The three-layered strap is formed by bonding the cover layers to the interior layer to form a unitary three-ply material. If desired, a design such as that shown at 96 in FIG. 7 may be stitched to the outermost layer of the strap.

In the preferred embodiment of the invention, the strapping system of the upper is formed from a one-piece pattern 94. Pattern 94 defines an upper strap 98 and a lower strap 100 in the instep region of the shoe. Straps 98 and 100 are generally rectangular in shape and are approximately 20 mm wide and 25 mm thick. The length of the strap varies depending upon placement of the strap on the upper of the shoe. For example, upper strap 98 is approximately 12 mm longer than lower strap 100, as the upper portion of the instep is wider than the lower portion. It should be noted by those skilled in the art that the exposed edges of the straps may be shaped to accommodate flexing or movement of the foot. For example, the top edge of upper strap 98 is curved at 102 to accommodate the upward movement of the instep as the foot travels through the gait cycle. Straps 98 and 100 each include a common attachment margin 104 at their ends which are stitched to the underside of inflatable chamber 18 to form a novel lightweight means for drawing the upper in close to the wearer's foot.

In the lateral and medial saddle region of the upper, a single strap 106 is provided. Strap 106 is part of pattern 94 and is therefore formed from the same three-layered laminate as straps 98 and 100. Strap 106 is hour-glass in shape in that it curves in at the mid-portion of the strap. The strap is placed within a void 108 (FIG. 7) in the medial and lateral saddle regions to closely draw the quarter and instep compartments of inflatable chamber 18 about the upper of the foot. Strap 106 is positioned within the void at an angle of approximately 45° so that the inflatable chamber moves with the foot as it travels through the gait cycle. An attachment margin 104' of pattern 94 is stitched to the underside of inflatable chamber 18 to secure strap 106 within void 108. In areas 99 of pattern 94, cut-outs 105 are provided so that the three-layered material of the strapping system does not interfere with inflation of the instep compartments of the chamber.

Figure 10:
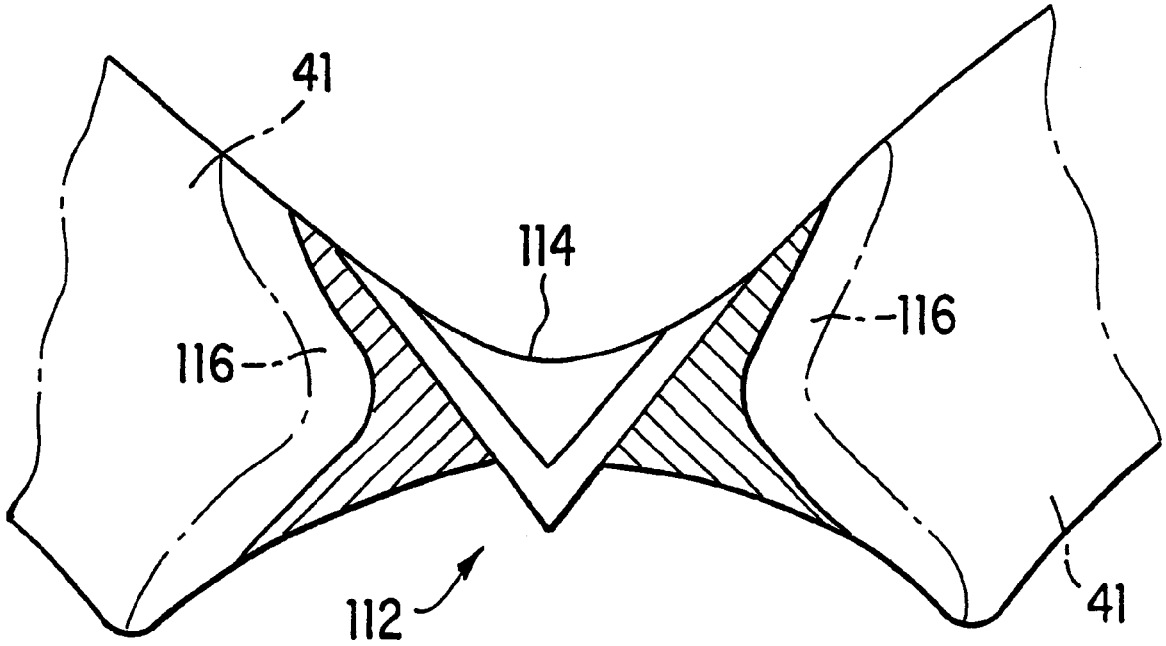
FIG. 10 is a top plan view of the achilles tendon strap.

Finally, an elastomeric strap 112 is attached to ankle collar compartments 84 of inflatable chamber 18 to bring them in about the ankle of the foot. As shown in FIG. 10, strap 112 is generally butterfly-like in shape. At mid-point 114, the strap is notched to accommodate the achilles tendon of the wearer. When properly attached to compartments 84, strap 112 wraps around the achilles tendon to comfortably draw compartments 84 about the ankle region of the foot to provide a secure fit. Strap 112, having a thickness of 3–4 mm, is preferably formed from a resin-injection moldable thermoplastic polyurethane (such as one manufactured by Advanced Resin Technologies). Strap 112 is provided with oppositely disposed attachment margins 116 which are stitched to the underside of compartments 84. If desired, a design such as that illustrated in FIG. 10 may be molded onto the exterior surface of the strap.

By varying the distances between the two instep and the two rearfoot compartments, the inflatable chamber of the invention may be applied to a variety of athletic shoe lasts by modifying at least the length of the instep and Achilles tendon straps.

Figure 11:
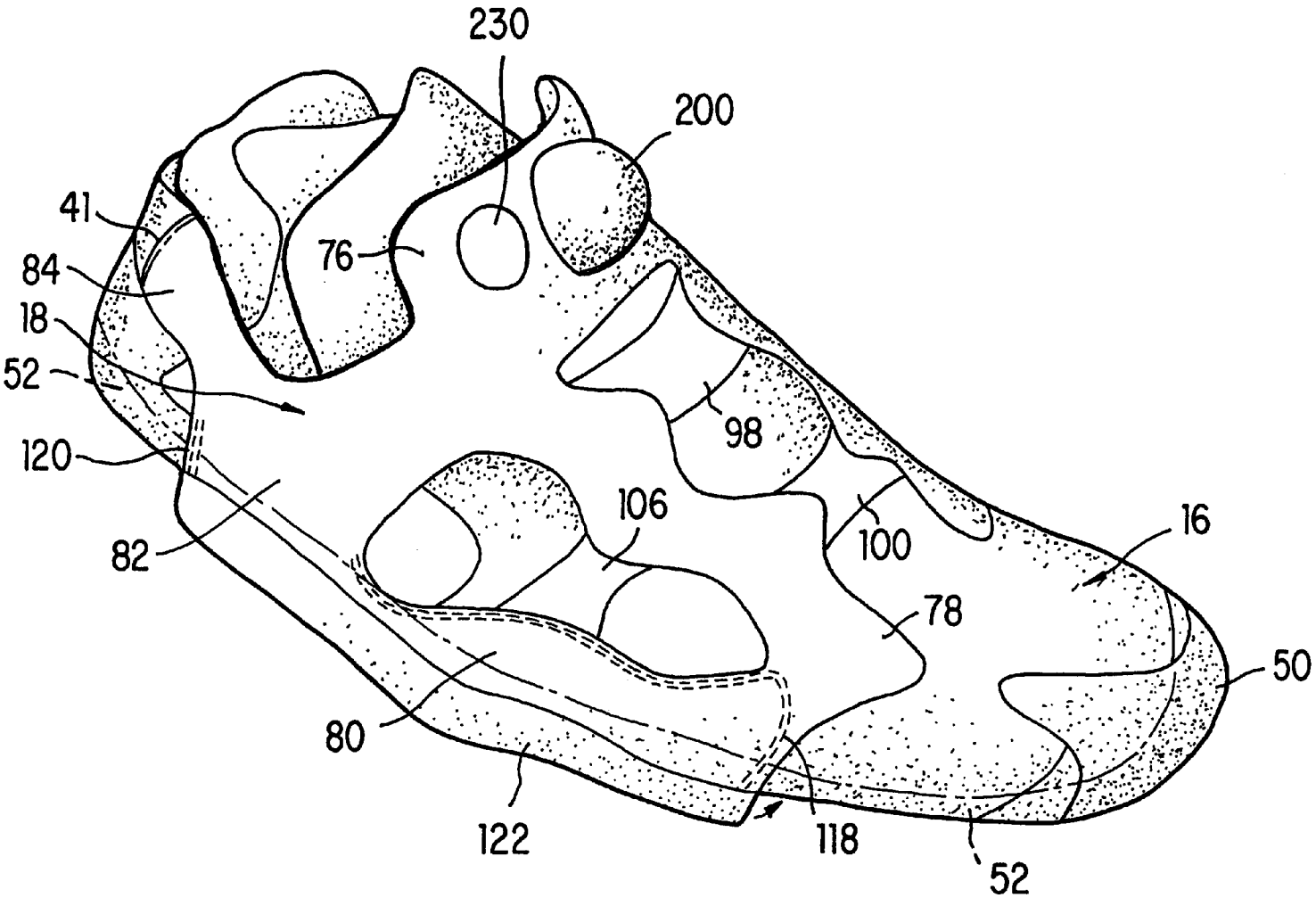
FIG. 11 is a perspective view of the lateral side of the upper.

Following attachment of the strapping system to inflatable chamber 18, the chamber is ready to be attached to foot conforming support member 16. As shown in FIG. 11, inflatable chamber 18 is stitched (in a double line manner) to foot conforming support member 16 along seams 118 and 120 on both the medial and lateral sides of the shoe. After completing the stitching step, a partial insole 54 (of the fiber-board type such as that shown in FIG. 12) is placed on an appropriately sized last. The assembled upper is then placed over the insole board and onto the last. Lasting margins 52 and 122 of foot conforming support member 16 and inflatable chamber 18, respectively, are then cemented to the edges of the insole board. At this point, the upper is now ready to be attached to the sole of the present invention.

3. The Inflation Mechanism

Figure 13:
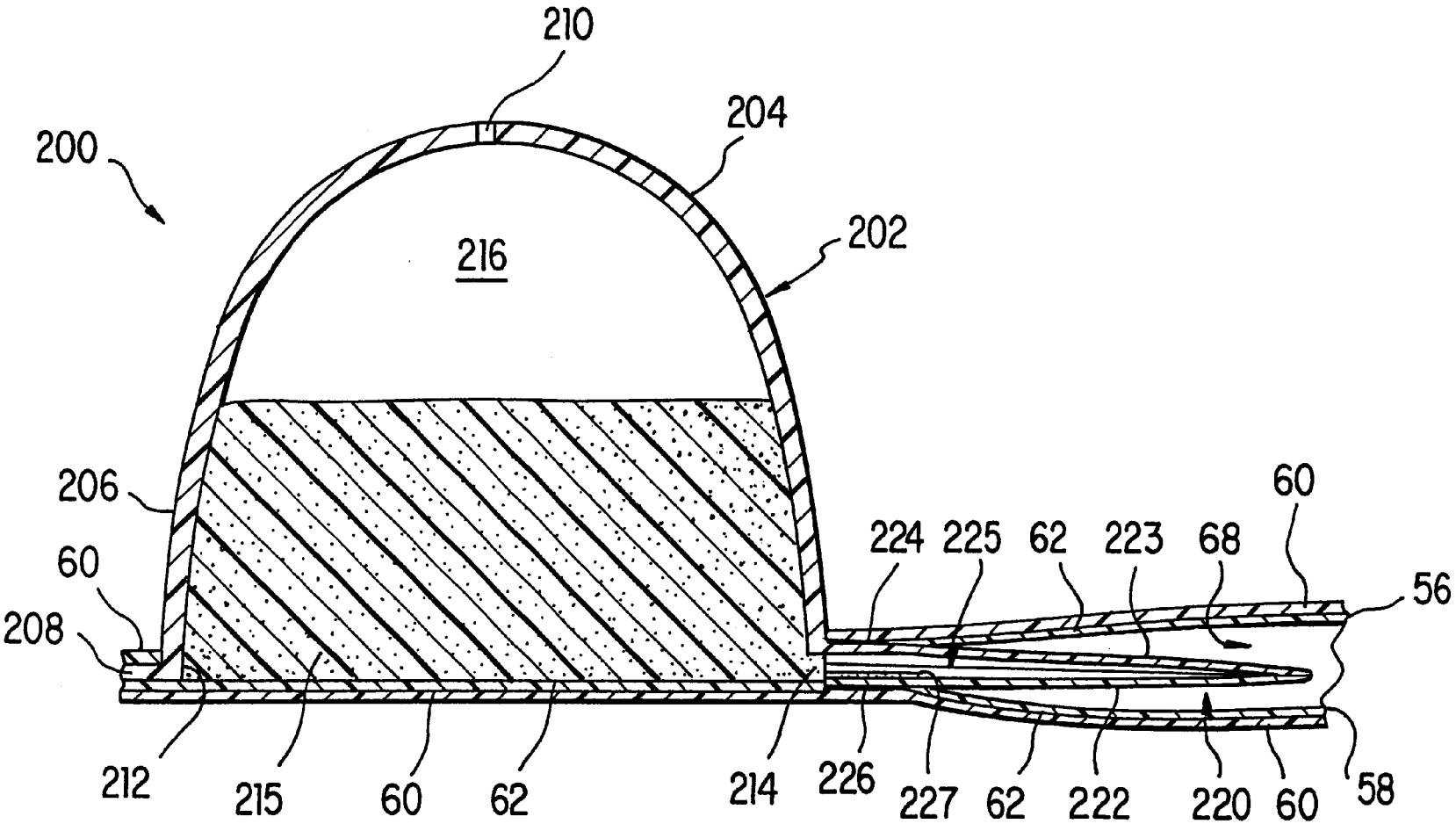
FIG. 13 is a cross-sectional view of the inflation mechanism of the invention.

As mentioned above, inflatable chamber 18 is provided with an on-board inflation mechanism 200. In the preferred embodiment, inflation mechanism 200 is located in tongue region 76 of chamber 18; however, inflation mechanism 200 may be located in any other convenient location such as the lateral side of the shoe. With reference to FIG. 13, inflation mechanism 200 has a body portion 202 which includes a domed top surface 204, a side wall 206 and a rim 208. Inflation mechanism 200 is preferably molded from rubber such as butyl rubber or latex rubber; however, it should be noted that inflation mechanism 200 may also be a molded urethane or any other material having exceptional memory characteristics. Alternatively, an open-celled, reticulated, resiliently flexible elastomeric material (such as polyurethane foam) may be disposed within interior 216 of inflation mechanism 200. Foam 215 preferably has 20 pores per inch, an uncompressed thickness of 12 mm and a volume of $6.367\times10^{-3}$ $m^2$. Foam 215 assists inflation mechanism 200 in quickly returning to its original pre-depressed condition. A hole 210 which functions as a fluid inlet is provided in top surface 204 of inflation mechanism 200.

Inflation mechanism 200 is fluidly attached to inflatable chamber 18 by placing the inflation mechanism over an appropriately sized aperture 212 provided in the tongue region of the chamber. Rim 208 is then attached to the chamber by rf welding the rim of the inflation mechanism to second lamina 62 of first laminate 56. It should be noted that the first (nylon) lamina of laminate 56 is absent in the area where inflation mechanism 200 is attached to the chamber. The rim of inflation mechanism 200 is welded about the circumference of aperture 212 except in a small area where a fluid outlet 214 is provided.

When the inflation mechanism is not in use, ambient air enters the interior 216 of the inflation mechanism through hole 210. When the user wishes to inflate chamber 18, the user places his thumb or finger over the hole and depresses top surface 204 into the interior of the inflation mechanism. As the top surface is depressed, the air within the interior of the inflation mechanism is forced through the outlet and into the fluid passageway of the chamber. During the pressure stroke, air is prevented from escaping to the atmosphere because the user's thumb or finger covers the hole. As the domed top surface returns to its original shape, ambient air flows into the interior of the inflation mechanism through hole 210. The user continues to the depress the top surface of the inflation mechanism until the desired pressure is obtained within the chamber.

Air already within the confines of the chamber is prevented from flowing back into the inflation mechanism by a duck-bill type check valve 220. Check valve 220 is positioned within the fluid passageway which extends directly from inflation mechanism 200 into passageway 68 of inflatable chamber 18. Check valve 220 is formed by a pair of urethane sheets 222 and 223 which are welded to the TPU layers of chamber 18 near inflation mechanism 200 at points 224, 226. Sheets 222 and 223 are sealed together along the side edges thereof to form a channel 225. Along its length, channel 225 is unsealed to provide a passageway for the one-way flow of air from inflation mechanism 200. It is essential that channel 225 remain open through the area of the seal, despite the fact that the outer surfaces of sheets 222 and 223 are sealed to the inner surfaces of second lamina 62. The unsealed zone along the length of channel 225 is provided for by a barrier material or coating 227 disposed between superimposed sheets 222 and 223. Barrier material 227 is of sufficient area and thickness to prevent the sealing together of sheets 222 and 223 during the welding of inflatable chamber 18. Check valve 220 is "biased" open at its inner end by outlet 214 of inflation mechanism 200. At the outer end of the check valve, sheets 222 and 223 have a tendency to merge into intimate surface-to-surface contact. This inherent surface-to-surface contact of sheets 222 and 223 prevents air already within the confines of the chamber from flowing back into the interior of inflation mechanism 200.

Barrier coating 227 may be applied by conventional printing techniques, such as silk screening, rotogravure or flexographic process. Preferably; the coating is applied as a composition in a liquid dispersion medium of an organic solvent or water base with a dispersed phase of finely divided microscopic particles, on the order of five (5) microns in diameter, of a polyethylene, a polytetrafluoroethylene (TEFLON™) or silicone. It is essential that the dispersion medium selected be one which will condition the surface of the urethane sheets to cause the microscopic particles to adhere, or be anchored to the surface of the sheets, to prevent sealing at the coated areas. A check valve of the type described above is further disclosed in U.S. Pat. No. 5,144,708, the disclosure of which is incorporated herein by reference. Although FIG. 13 illustrates only one type of inflation mechanism, any other inflation mechanism which may be affixed to the upper without interfering with the intended use of the shoe may be used. Other inflation mechanisms suitable for inflating the chamber of the invention are disclosed in U.S. Pat. No. 5,113,599, for example, the disclosure of which is also incorporated herein by reference.

4. The Fluid Release Mechanism

Figure 14:
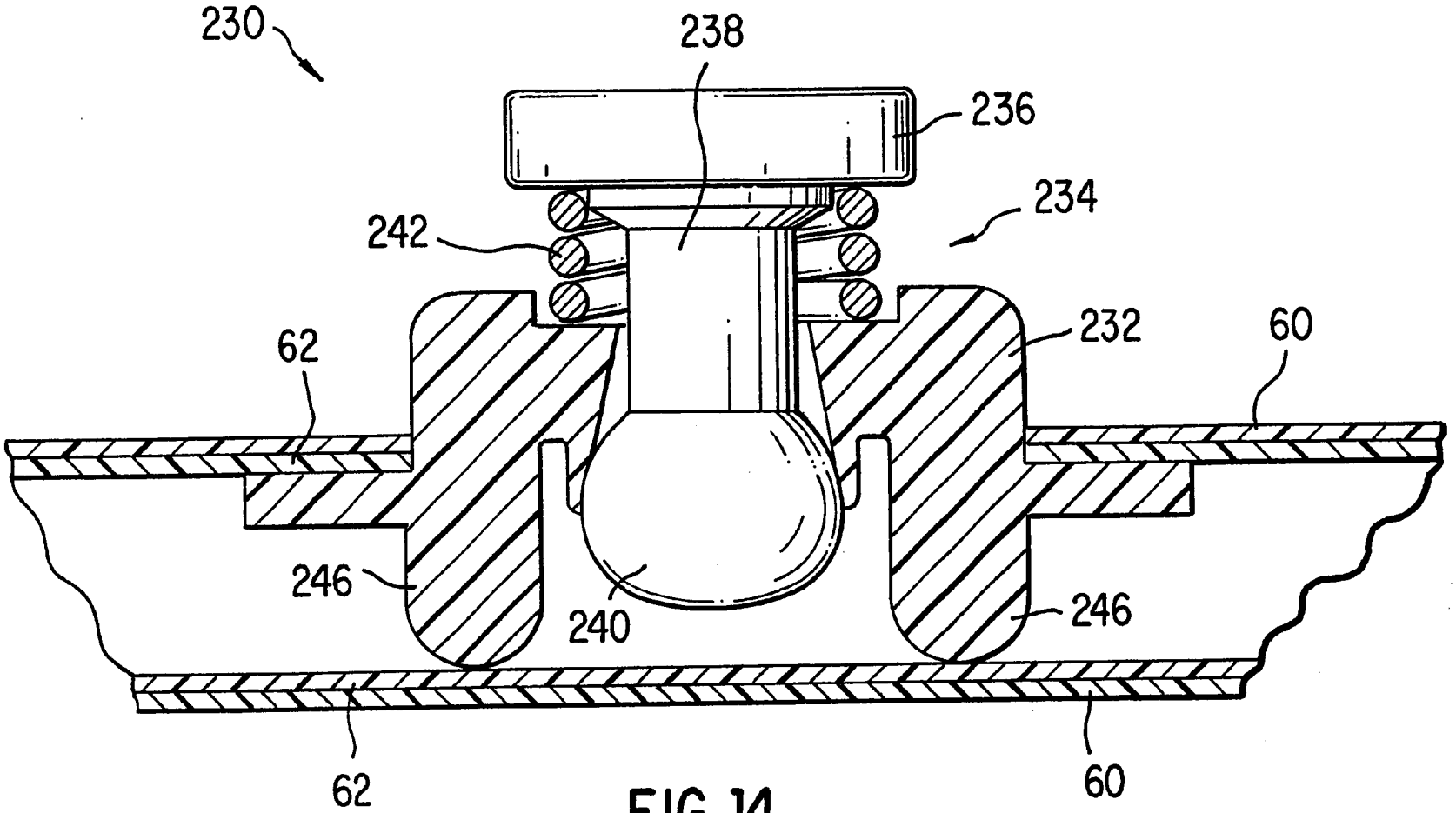
FIG. 14 is a cross-sectional view of the fluid release mechanism of the invention.

With reference now to FIG. 14, a fluid release mechanism 230 is provided approximate inflation mechanism 200. Release mechanism 230 is fitted within an aperture of chamber 18 to enable venting or deflation of the chamber. While the fluid release mechanism of the invention may be located anywhere on chamber 18, it is preferable that the mechanism be located where it can be conveniently activated by the user.

Fluid release mechanism 230 generally includes a housing 232 and a fitting 234 for controlling the flow of fluid through the mechanism. Housing 232 is preferably a molded thermal-polyurethane which may be easily attached (by rf welding, for example) to the TPU lamina of first laminate 56. At the bottom of housing 232, a plurality of extensions 246 are provided to prevent the bottom layer of chamber 18 from interfering with operation of the release mechanism.

Fitting 234 comprises a plunger 236 having a stem portion 238 and a stop member 240. A coil spring 242 is disposed about the stem portion of plunger 236 to bias fitting 234 in the shown closed position. As illustrated in FIG. 14, when plunger 236 is in the closed position, stop member 240 of plunger 236 abuts against an annular shoulder 244 of housing 232 to prevent leakage of air from chamber 18. The fitting of the fluid release mechanism may be made out of a number of materials including plastics, lightweight metals (such as aluminum) or any other material capable of being molded to a particular specification.

Figure 15:
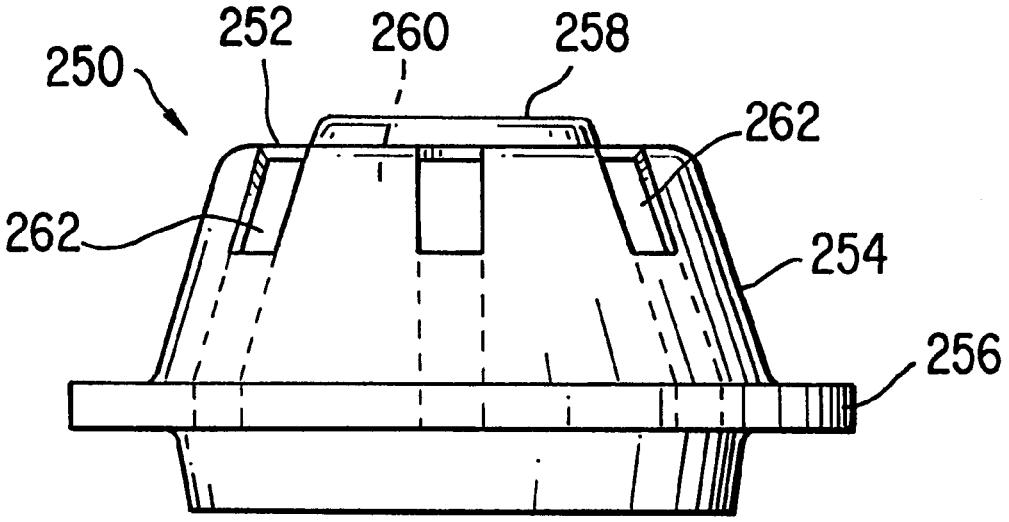
FIG. 15 is a side elevational view of the cover of the fluid release mechanism.
Figure 16:
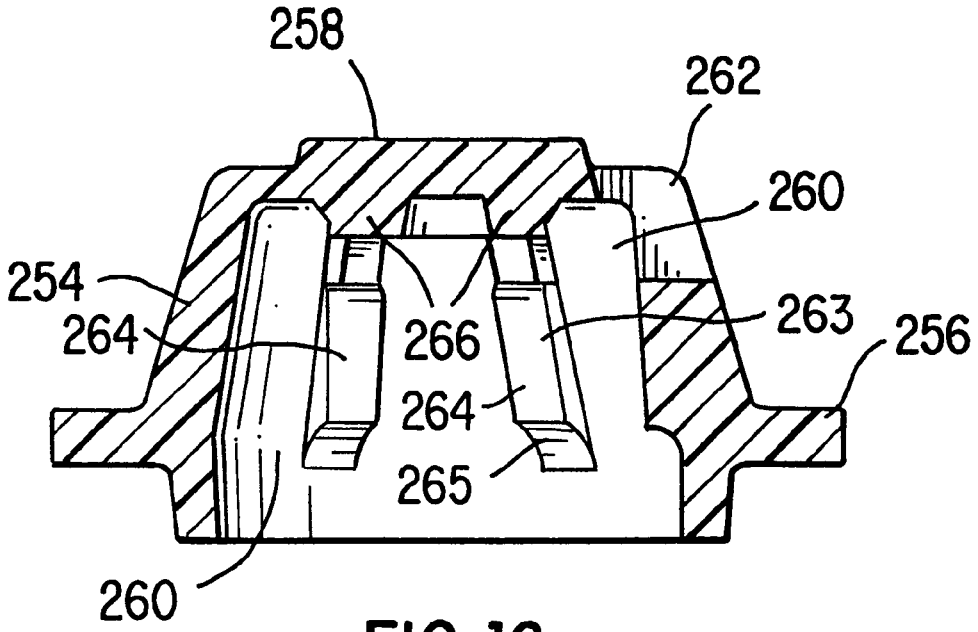
FIG. 16 is a cross-sectional view thereof.
Figure 17:
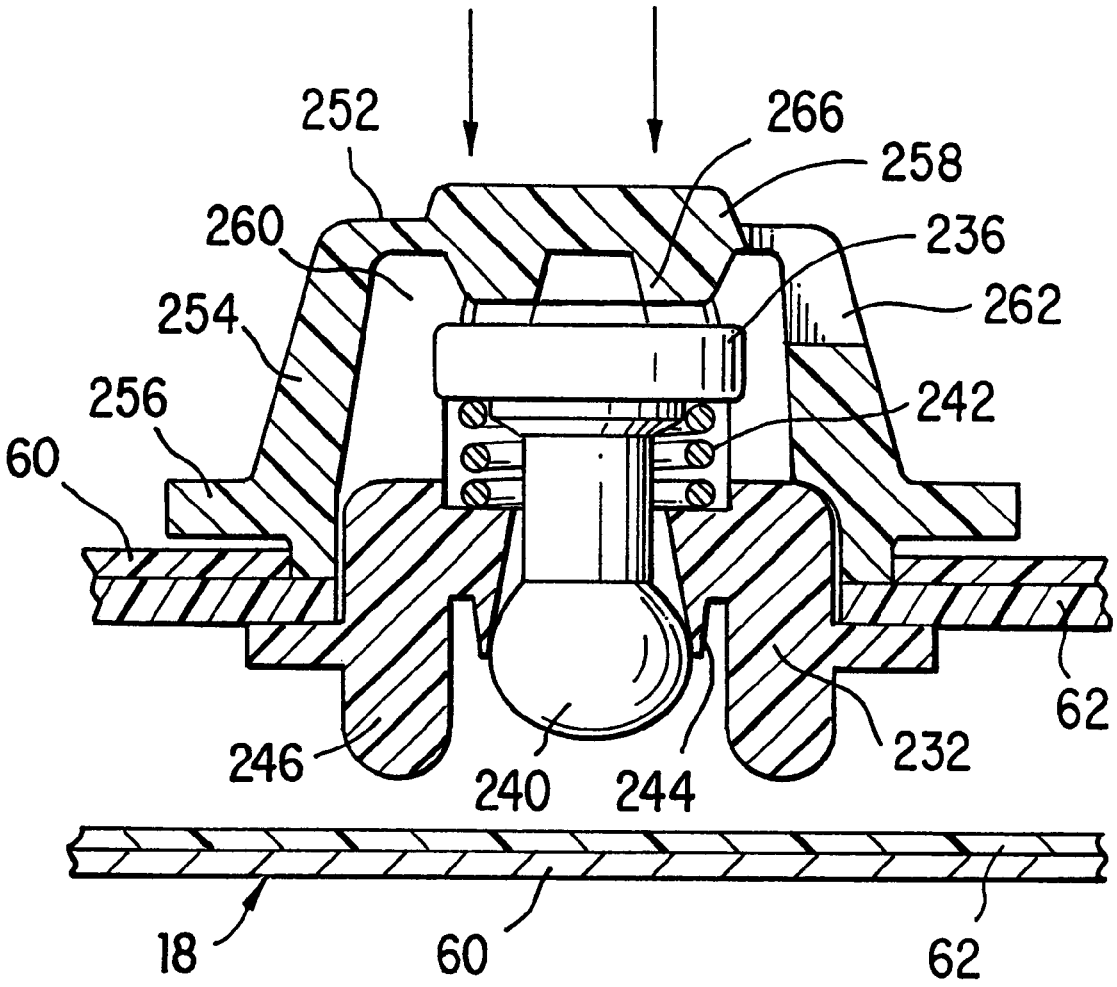
FIG. 17 is a cross-sectional view of the fluid release mechanism including the cover shown in FIG. 16.

Securingly received about fluid release mechanism 230 is a cover 250 (see FIGS. 15–17). Cover 250 of the present invention serves a dual function. In one aspect of the invention, cover 250 prevents dirt and other particulate matter from entering the interior of the release mechanism. In another aspect, cover 250 serves as a connector or coupling means for use with an "off-board" inflation mechanism, a discussion of which is provided below.

Cover 250 is preferably formed from a moldable, elastic material. ESTANE™, available from B.F. Goodrich, or PELLETHANE™, available from Dow Chemical Corporation are both suitable products for forming cover 250. Cover 250 is approximately 1.0 mm thick and includes a top surface 252, a cylindrical side wall 254, and a rim 256. Top surface 252 has a diameter of approximately 9.69 mm and includes a 5.0 mm boss 258 standing 0.5 mm high. Side wall 254 is angled at approximately 18° and stands approximately 5.0 mm high from rim 256. Obviously, the dimensions of the cover may be modified to accommodate a fluid release mechanism of any size. Together, top surface 252 and side wall 254 define an interior area 260 which receives the fluid release mechanism when the cover is positioned thereon.

As best seen in FIGS. 15 and 16, defined within the common edge of the side wall and top surface are a plurality of apertures 262. Preferably, cover 250 includes six equiangularly spaced apertures. Naturally, any number of apertures may be provided to allow fluid to enter and exit the fluid release mechanism. Apertures 262 are approximately 2.4 mm in length and 1.5 mm in width.

With reference now to FIG. 16, the internal components of cover 250 are shown. Molded onto the internal surface of side wall 254 are several posts 264. At their upper ends 263, posts 264 engage with the side portion of plunger 236 to provide positive interaction or contact with the same. The lower ends of the posts are beveled (as at 265) to snugly sit on the rounded upper portion of housing 232. Posts 264, which are approximately 2.3 mm in length, are preferably molded directly beneath apertures 262. In addition, posts 264 are tapered in thickness to assist in the outward bowing of the side wall when the cover is depressed to release fluid from chamber 18.

Molded onto the underside of top surface 252 is a ring-like projection 266 which comes into contact with plunger 236 to assist in depression of the same when a force is applied to the top surface of the cover. Although projection 266 is illustrated as a ring, it should be realized by those skilled in the art that multiple projections of any shape may be provided so long as they do not interfere with the escape or introduction of fluid into the chamber.

With reference now to FIG. 17, the cover of the present invention is shown received about the fluid release mechanism 230. The bottom portion of the cover is bonded to the exterior of housing 232 using a suitable adhesive. If the user wishes to vent the chamber of air contained therein, a force (in the direction of the arrows) is applied to boss 258. As the top surface is depressed, projection 266 comes into contact with plunger 236 to depress the same and open the fluid release mechanism. In addition, as the side walls are depressed, the side wall 254 bows outwardly to open up the space between the fluid release mechanism and the cover. As the fluid release mechanism opens, stop member 240 moves away from shoulder 244 and air flows around the stop member and the stem portion of plunger 236. Fluid, now within the confines of the cover, escapes therefrom by flowing out of apertures 262. When the desired amount of fluid has been vented, the user removes the force from the top surface of the cover, projection 266 moves away from the plunger and coil spring 242 (biased against the stem of the plunger) brings stop member 240 back into contact with annular shoulder 244. The fluid release mechanism is now in the closed position to prevent air from exiting the inflatable chamber.

Alternatively, and as mentioned heretofore, the cover of present invention also functions as a connector or coupling means for an off-board inflation mechanism. The off-board inflation mechanism may be a pressurized gas inflation device such as that disclosed in U.S. application Ser. No. 08/109,995, filed Aug. 23, 1993, the specification of which is incorporated herein by reference. A preferred pressurized gas inflation device is illustrated as 280 in FIG. 18. Inflation device 280 generally includes a housing 282 which receives a cartridge of pressurized gas, a head unit 284 which houses a valve assembly for controlling the flow of gas through the device, and a nozzle 286. Nozzle 286 is provided with a restrictor valve for controlling the flow rate of the fluid passing through the device and a pressure relieving means 285. Pressure relieving means 285 is automatically activated when the pressure within the inflatable chamber reaches a threshold level to prevent over inflation which could damage the chamber compartments.

To inflate chamber 18 using inflation device 280, nozzle 286 of the device is disposed about cover 250. As the nozzle is fitted onto the cover, an internal component of the nozzle engages with the top surface of the cover to depress the same. As the top surface is depressed, projection 266 comes into contact with plunger 236 to open fluid release mechanism 230 in the manner previously described. When the fluid release mechanism has been properly opened, fluid from inflation device 280 is released. This fluid enters the cover through apertures 262 and enters chamber 18 through the now opened fluid release mechanism 230. When the chamber has been inflated to the desired pressure, the nozzle is removed from the cover. The absence of the force applied against top surface 252 allows fitting 234 to return to the closed position to seal the inflating fluid within the bladder. Fluid may be vented from the inflatable chamber in the same manner previously described.

B. The Sole

Now that the structure and function of the upper has been fully described, attention will be directed to the sole of the present invention. As stated in the Background of the Invention section above, the sole of a typical athletic shoe accounts for at least 50–62% of the total shoe weight. Thus, to significantly reduce the total weight of a shoe, steps must be taken to reduce the weight of the sole, as only a certain amount of weight may be removed from the upper of the invention to avoid comprising the structural integrity of the same.

The sole of an athletic shoe generally serves three purposes: cushioning, protection and support. Any one of these functions may be accomplished by numerous materials or structure. Oftentimes, however, such structure adds substantially to the weight of the shoe. Thus, to achieve a sole which is lightweight, the components thereof must be structured in a minimalistic fashion from materials which are functionally efficient.

Figure 19:
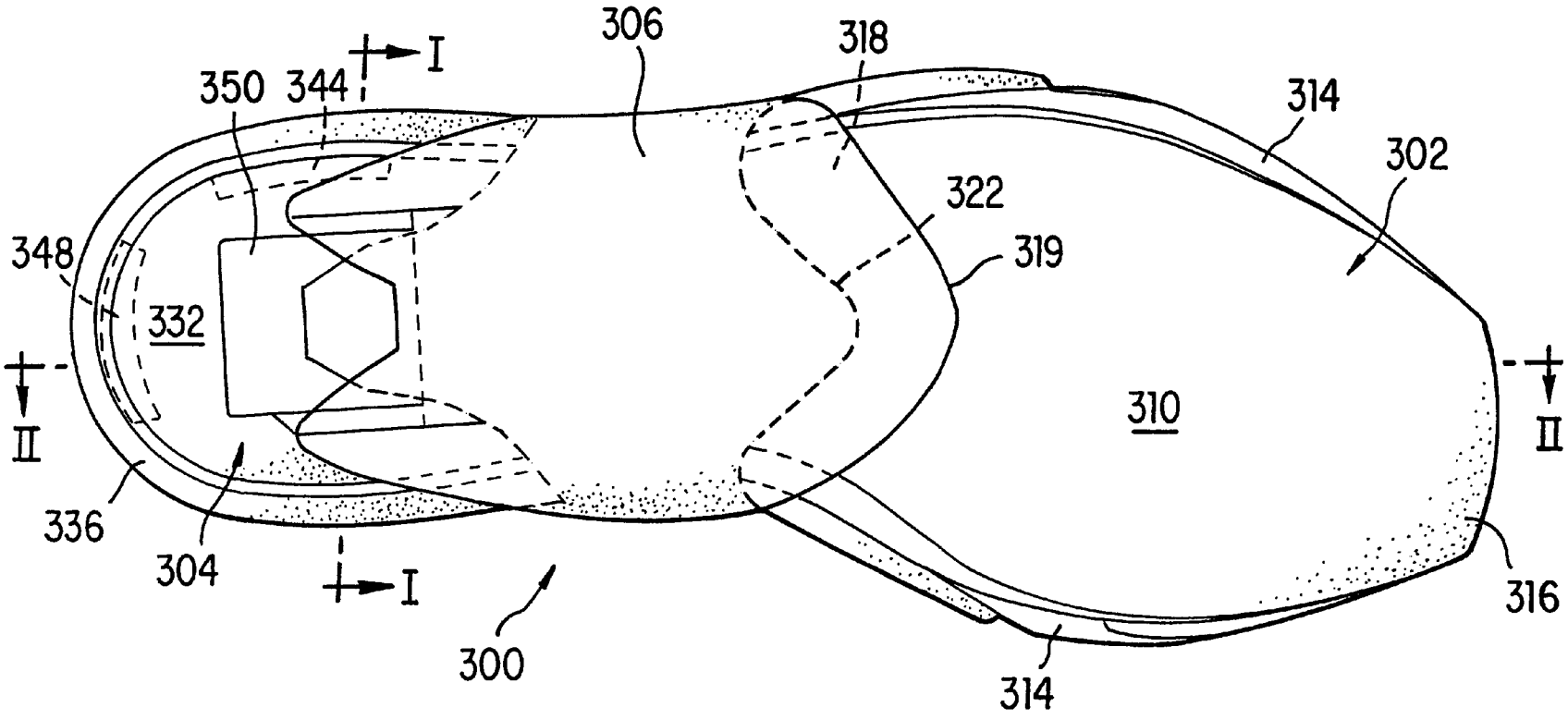
FIG. 19 is a top plan view of the sole of the present invention.

The sole of the present invention accomplishes this objective. With reference now to FIG. 19, a top plan view of the sole 300 of the invention is disclosed. Sole 300 includes a forefoot piece 302, a heel piece 304, and an arch support 306. Forefoot piece 302 underlies the forefoot region of the foot and generally extends from the transverse arch to the end of the toes. In the preferred embodiment, heel piece 304 is generally v-shaped and underlies the heel of the wearer's foot. Arch support 306 lies beneath the medial arch of the foot and extends between forefoot piece 302 and heel piece 304 to provide a bridge between the same.

1. The Forefoot Piece

Figure 20:
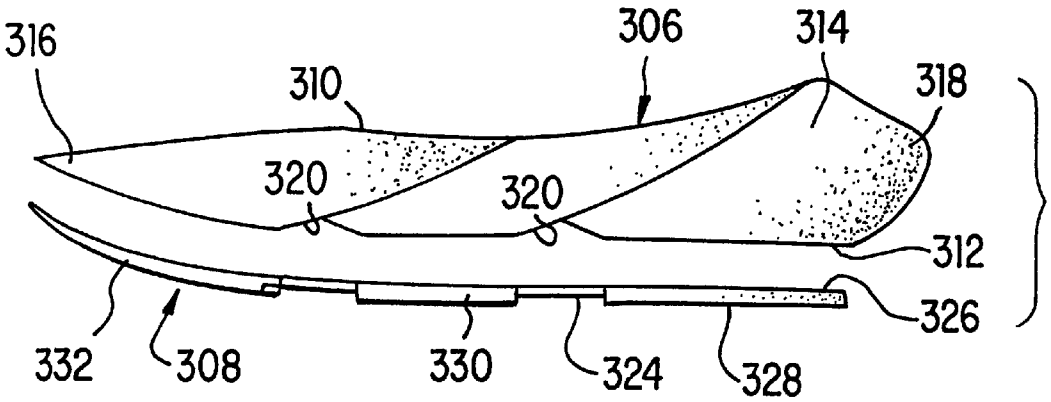
FIG. 20 is an exploded side elevational view of the forefoot piece of the sole.

Forefoot piece 302 follows the outer profile of the forefoot to provide support and cushioning to the same. With reference now to FIGS. 19 and 20, forefoot piece 302 includes a midsole component 306 and an outsole component 308. Midsole component 306 has a thickness which defines a top surface 310, a bottom surface 312, and a side wall 314. As most clearly seen in FIG. 20, midsole component 306 tapers in thickness from 12 mm at transverse end 318 to 1.0 mm at toe end 316 to facilitate the toe-off phase of the gait cycle.

Figure 21:
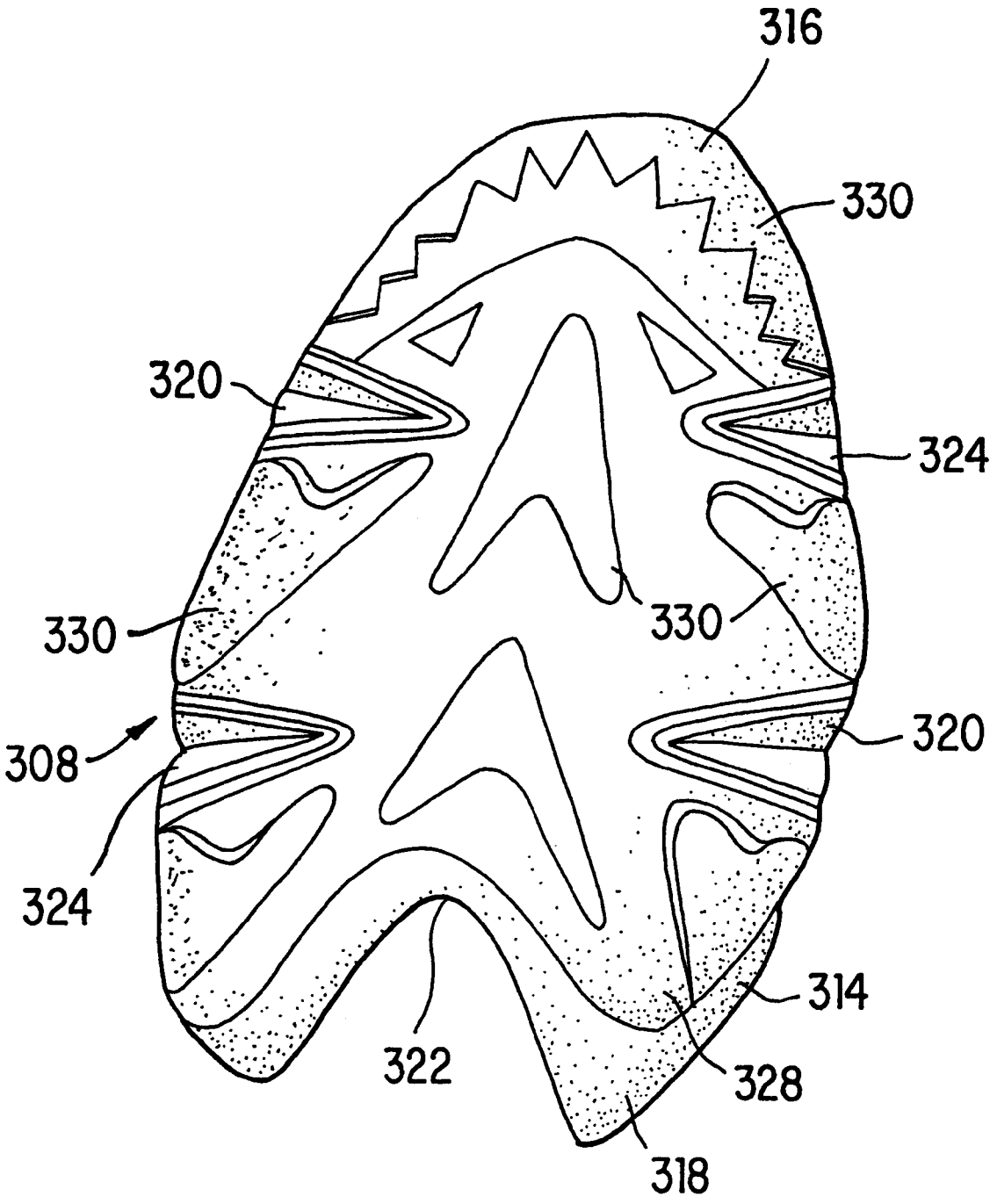
FIG. 21 is a bottom plan view of the forefoot piece.

In bottom surface 312, midsole component 306 is provided with a series of v-shaped flex grooves 320 which extend from the peripheral edge of the component to an interior point. FIG. 21 illustrates the placement of flex grooves 320 about the bottom surface of forefoot piece 302. Flex grooves are approximately 8.0 mm deep at their deepest point and 27.0 mm long. At the transverse arch end of midsole component 306, side wall 314 is beveled and notched (as at 322) to further facilitate flexing of the forefoot piece at that edge.

Provided within the top surface of midsole component 306 is a ridge 319 (FIG. 19) which supports the forward edge of the arch support of the invention which is discussed in more detail below.

Midsole component 306 is preferably compression molded from ethyl vinyl acetate (EVA) foam having a durometer of 51+/−3 on the Asker C scale. A suitable EVA for foam midsole component 306 is sold under the trademark ECLIPSE 2000 by Eclipse Polymers Co. Ltd. Naturally, other materials may be used to form the midsole component of the sole, including foamed polyurethane and HYTREL™ foam having a hardness of 51+/−3 Asker C.

Attached to bottom surface 312 of midsole component 306 is an outsole component 308. The outer profile of outsole component 308 mimics that of the bottom surface of midsole component 306. Outsole component 306 is preferably molded from an abrasion resistant material such as rubber or the like. Similar to midsole component 306, outsole component 308 is provided with a series of v-shaped flex grooves 324 which correspond in placement to flex grooves 320 to assist in flexing of the outsole.

Outsole component 308 has a thickness of approximately 2.0 mm which defines an upper surface 326, a lower surface 328 and a side wall 332. Provided on lower surface 328 of outsole component 308 are several lugs 330 which give the shoe increased traction capabilities. Lugs 330 are approximately 4.0 mm thick, extending approximately 2.0 mm below the lower surface of the outsole component. Although lugs 330 are shown as being generally v-shaped, it should be realized by those skilled in the art that lugs 330 may assume any configuration.

The outsole component 308 of forefoot piece 302 is bonded to the bottom surface of the midsole component using an adhesive which is conventional in the shoemaking art.

2. The Heel Piece

Figure 22:
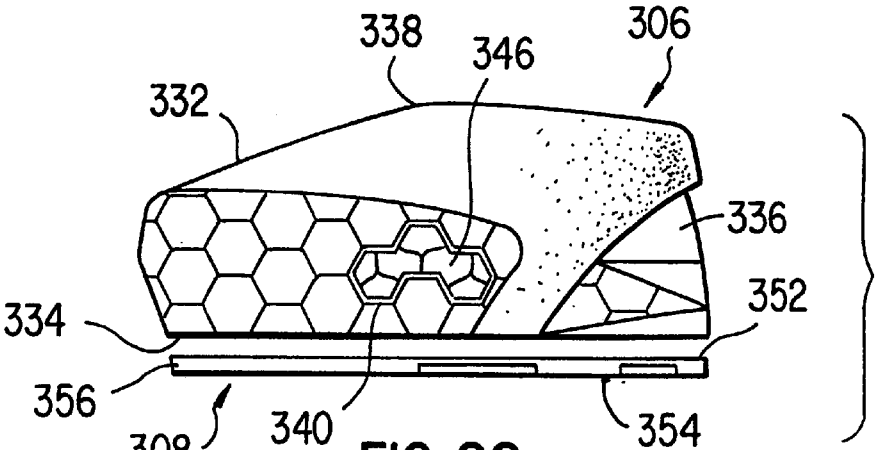
FIG. 22 is an exploded side elevational view of the heel piece of the sole.
Figure 23:
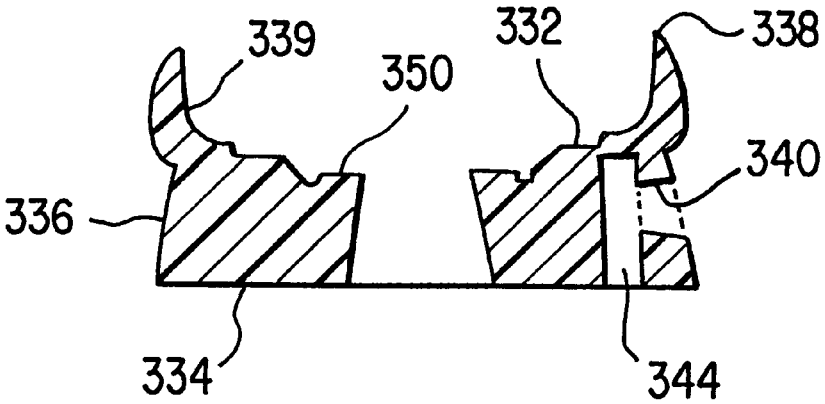
FIG. 23 is a cross-sectional view of the midsole of the heel piece taken along line I—I in FIG. 19.
Figure 24:
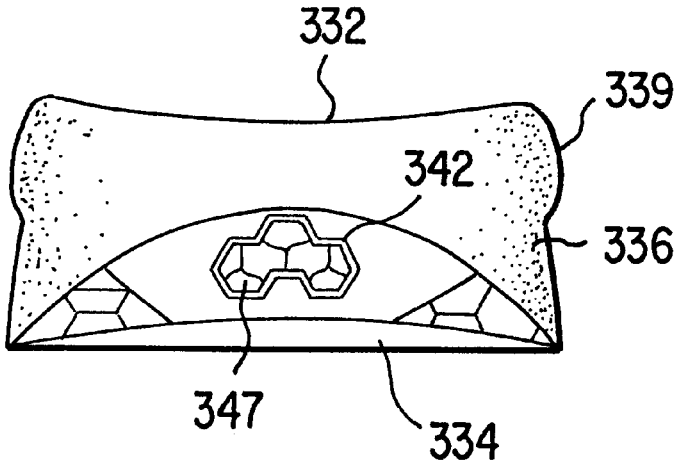
FIG. 24 is a rear elevational view of the midsole of the heel piece.
Figure 25:
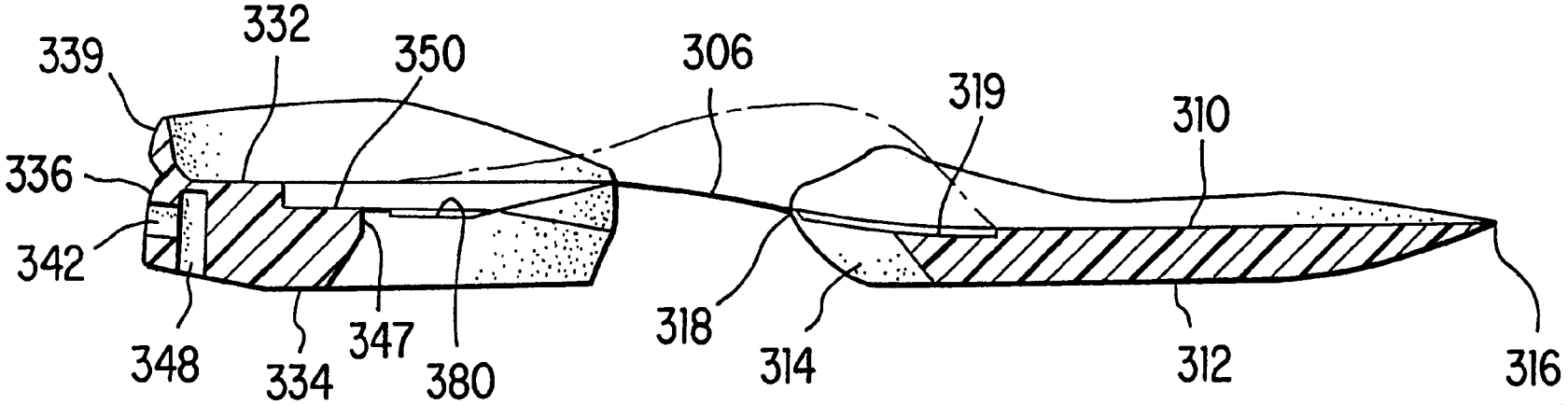
FIG. 25 is a cross-sectional view of the sole of the invention taken along line II—II in FIG. 19.

Provided at the heel end of athletic shoe 10 is a generally v-shaped heel piece 304 (see FIG. 22). Heel piece 304 may be provided with any design or pattern including that shown in FIG. 22. Heel piece 304 is similar to forefoot piece 302 in that it too includes a midsole component 306 and an outsole component 308. The midsole component of heel piece 304 is preferably molded from the same EVA foam as forefoot piece 302. In the heel, midsole component 306 has a thickness of approximately 4.3 cm which defines a top surface 332, a bottom surface 334, and a side wall 336. As seen in FIG. 22, the top edge of side wall 332 curves upwardly at 338 to form a cup 339 (see FIG. 23) for supporting the heel to prevent the foot from rolling over during heel strike. As seen in FIGS. 22 and 24, side wall 336 is provided with a lateral cut-out 340 and a rear cut-out 342 which allow the user to see the internal cushioning components of the midsole. As shown in FIG. 23, lateral cut-out 340 leads to a lateral cavity 344 which receives a cushioning component 346 (FIG. 24), the details of which will be described in more detail below. Lateral cut-out 340 is provided to soften the lateral edge of the heel piece to prevent the foot from over pronating during heel strike. Alternatively, this function may be accomplished by decreasing the density of the midsole material along the lateral edge of the heel piece. As shown in FIG. 25, rear cut-out 342 leads to a rear cavity 348 which receives a second cushioning component 347. Cavities 344 and 348 are molded in the midsole component during the molding process. (Alternately, cavities 344 and 348 may be carved out of the midsole component after molding). After the midsole component has cured, cut-outs 340 and 342 are cut and punched through to the respective cavities.

With reference again to FIGS. 19 and 25, top surface 332 of midsole component 306 is provided with a shelf 350 which supports a third cushioning component 349 positioned directly beneath the calcaneus of the foot to provide cushioning to the same.

In the preferred embodiment, cushioning component 346, 347 and 349 is a gas-tight honeycombed structure such as that manufactured under the trademark HEXALITE by Hexcel Corporation. For the cushioning purposes of the present invention, the cell walls of the honeycombed structure should be at least 5.0 mm high, but no more than 5.5 mm high. In the lateral and rear cavities of the heel piece, cushioning components 346 and 347 are positioned within the cavity so that the cell walls of the honeycombed structure are perpendicular to side wall 336. Perpendicular positioning of cushioning components 346 and 347 allows the user to see the individual cells of the cushioning structure through cut-outs 340 and 342.

In the top surface of the midsole, cushioning component 349 is placed on shelf 350 so that the cell walls of the honeycombed structure are parallel to side wall 336 to provide maximum cushioning to the heel of the wearer. A portion of cushioning component 349 is exposed to the exterior of the sole, as the same extends beyond notch 347 of heel piece 304 to render the cushioning component visible to the wearer.

Although the cushioning component of the invention is preferably a honeycombed structure, other cushioning materials may be utilized in the sole of the present invention. For example, HYTREL™ tubes or inflatable technologies may be employed within the cavities of the heel to provide cushioning to the foot of the wearer.

Figure 29:
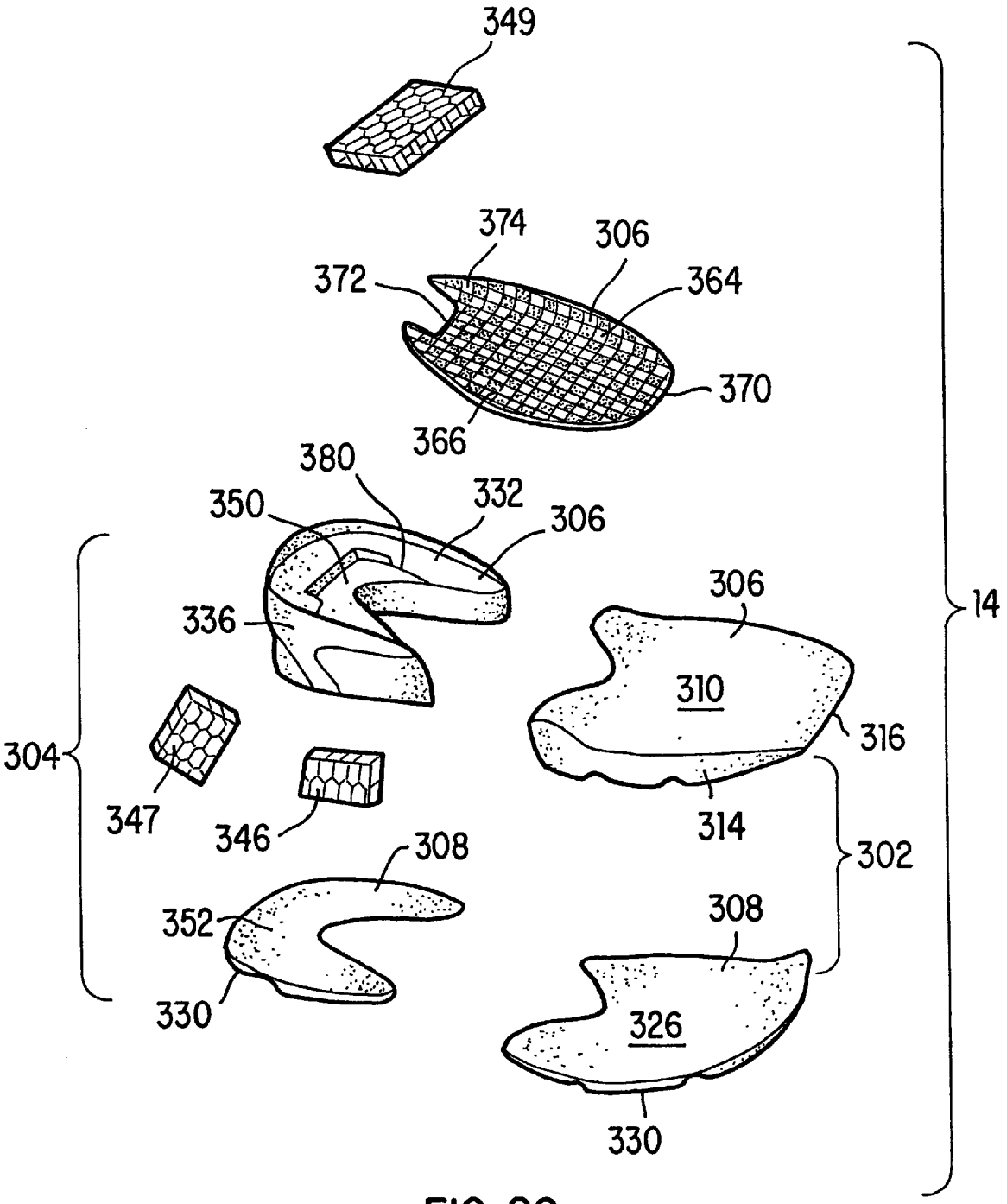
FIG. 29 is an exploded view of the components of the sole of the invention.

With reference to FIG. 29, cushioning components 346, 347 and 349 are inserted into the midsole component of the heel piece after the midsole has cured. Following proper positioning of the cushioning components, an outsole component 308 of the heel piece is adhesively bonded to midsole component 306.

Figure 26:
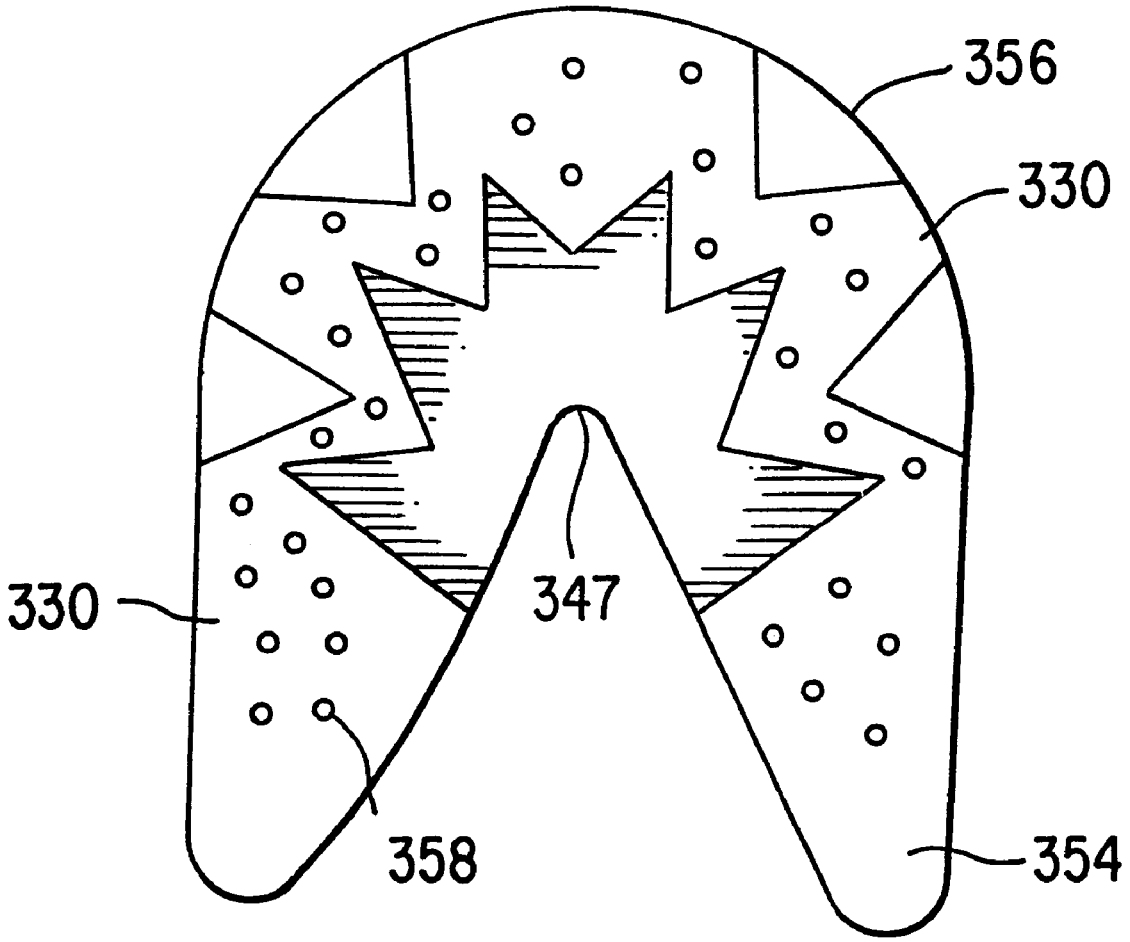
FIG. 26 is a bottom plan view of the heel piece of the sole.

With reference now to FIGS. 22 and 26, outsole component 308 of heel piece 304 is molded from the same abrasion-resistant material discussed above with regard to the forefoot outsole component. Heel outsole component 308 has a thickness of approximately 4.0 mm which defines an upper surface 352, a lower surface 354 and a side wall 356. Provided on the lower surface of outsole component 308 is a lug 330 which extends around the periphery of the component. Also provided within the lower surface are several perforations 358 which help the outsole grip the running surface. Naturally, outsole component 308 may be provided with any other lug configuration.

4. The Arch Support

Bridging forefoot piece 302 and heel piece 304 is an arch support 306. Arch support 306 is placed beneath the medial arch of the foot for the purpose of supporting the foot of the wearer in the arch region. By using a stiff support member in the arch area of the shoe, considerable weight may be saved, as conventional midsole and outsole materials may be eliminated in light of the fact that cushioning is not necessary in the arch region of the shoe. In order to accomplish the objectives of the present invention, it is imperative that arch support 306 take a certain geometry which is discussed in detail below.

Figure 28:
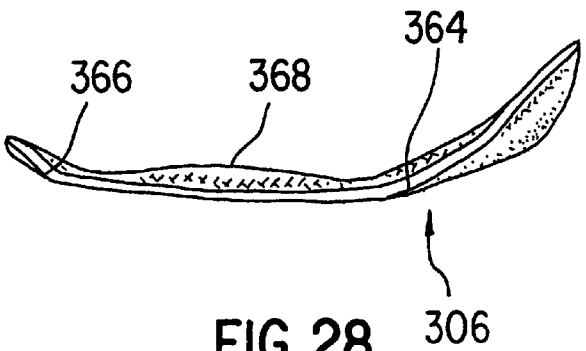
FIG. 28 is a rear elevational view thereof.
Figure 27:
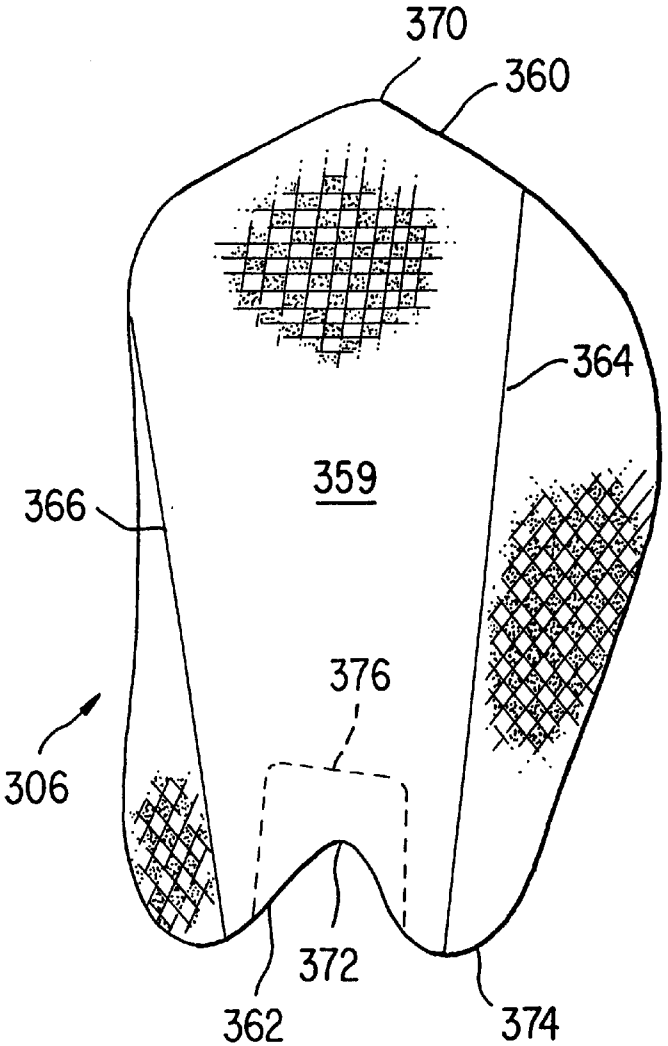
FIG. 27 is a top plan view of the arch support of the invention.

With reference now to FIGS. 19 and 27, arch support 306 includes a substantially planar main surface 359 which spans across the entire width of shoe 10 to define a medial edge 364 and a lateral edge 366. At medial edge 364, main surface 359 of arch support 306 curves upwardly (at approximately 60°) to conform to the arch of the wearer. Where the main surface curves upwardly, arch support 306 becomes very rigid and therefore resistant to flex. This is so because the curve along the medial edge has essentially an I-beam effect which strengthens the support and rigidifies the same. The resistance of the support to flex is important in this particular region, as the arch of the foot must be rigidly supported during each phase of the gait cycle. As the curve of the arch extends to the anterior edge 360 of the support, the degree of curvature is lessened to approximately 6° to facilitate flexing of the arch support at the metatarsal head region of the foot. In the mid-section of support 306, main surface 359 extends across the width of the foot at a radius of curvature of approximately 3°. As seen in FIG. 28, the main surface curves (as at 368) between medial edge 364 and lateral edge 366 to provide less resistance to flex along the lateral edge and more resistance to flex along the medial edge. As you move toward anterior edge 360, main surface 359 flattens out to increase the flexibility of the piece at the metatarsal head region of the foot. In addition, the anterior edge of the support comes to a point (as at 370) to increase the amount of flexibility for toeing off. Thus, the flexibility of the support increases as you move toward the anterior edge of the support, with the most flexible portion of the support being at point 370.

Along lateral edge 366 of support 306, main surface 359 curves slightly upward at an angle of 3°. The lateral edge of support 306 is curved upwardly for the sole purpose of bonding the arch support to the lateral edge of the upper. It is imperative that support 306 not wrap up onto the lateral edge of the shoe, as such an extreme curve would inhibit the flexibility of the arch support to the point that the support would crack or cause injury to the user.

At the posterior edge 362 of arch support 306, the main surface is notched at 372 to define to ears 374. Ears 374 are provided to allow the arch support to deflect in the heel region so that the midsole of the heel piece is capable of performing its inherent energy absorbing function.

Notch 372 also allows the user to inspect cushioning component 349 positioned immediately above the arch support in the heel region of the sole. The cushioning component is prevented from deflecting through the notch by way of a shelf 376 which is provided in the main surface of the arch support near notch 372. Shelf 376 is not pronounced, as such a surface variation would inhibit deflection of ears 374 into the midsole component of the heel piece.

Arch support 306 is preferably a woven carbon/glass composite. The composite is preferably 30/1000 inch, but may be as thick as 50/1000 inch. In the preferred embodiment, the carbon material of the composite runs in the anterior-posterior direction of the arch, while the glass is oriented in the medial-lateral direction. Using a 2×2 twill weave of 50% carbon and 50% glass, an epoxy or acrylic resin is poured over at least one surface of the support. Two such suitable composites for the arch support of the present invention are manufactured by Hexcel Corporation and Mechanical Composites under product numbers XC1289 and TW1000, respectively. Other materials for use in making the arch support of the present invention include a carbon/aramid KEVLAR/glass composite. Polypropelene, or NUCREL™, a resin available from E.I. DuPont de Nemours, may also be used to coat the arch support of the present invention.

The sole of the present invention is lasted to the upper by conventional bonding techniques. With the upper positioned on a suitably sized last, the arch support (with an adhesive applied to the upper surface of the support) is adhered to the upper in the arch region thereof. The arch support is positioned so that the curved arch portion of the support wraps up onto the arch of the upper. After the adhesive has set, an adhesive is applied to the upper surface of forefoot piece 302 to adhere the same to the forefoot portion of the upper. An adhesive is then applied to the top surface of the heel piece so that the same may be adhered to the heel portion of the upper. Heel piece 304 is positioned on the upper so that ears 374 fit within groove 380 provided in the top surface of the heel piece. After completing this step, the assembled shoe is removed and a conventional sockliner 390 shown in FIG. 2 is inserted into the shoe.

Figure 30:
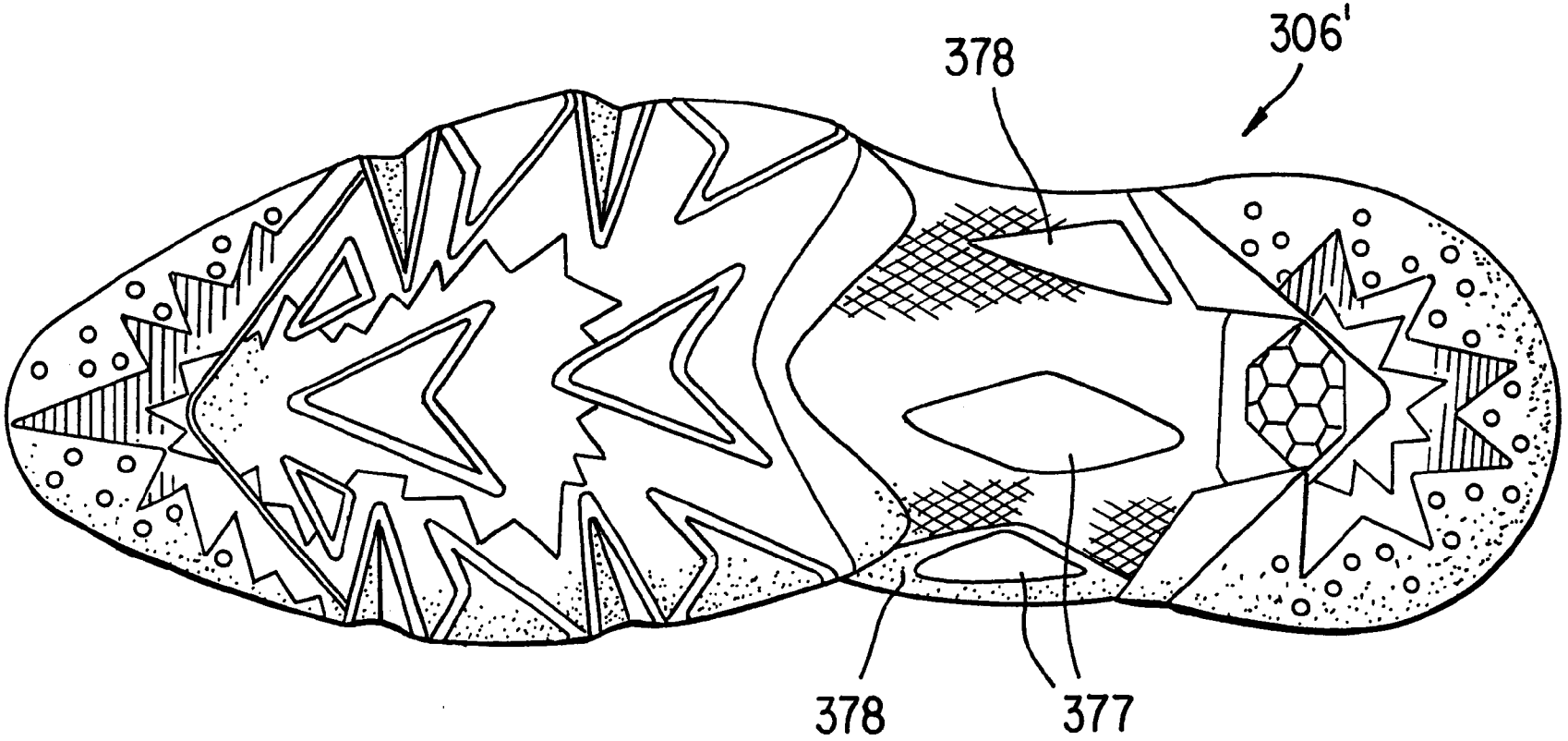
FIG. 30 is a bottom plan view of the athletic shoe of the present invention incorporating an alternate embodiment of the arch support shown in FIG. 27.

FIG. 30 discloses an alternative embodiment of arch support 306. Arch support 306' is similar in many respects to arch support 306 in that it is pointed at the anterior edge, curves upwardly at the medial edge, and is provided with a notch and ears along the posterior edge of the support. Arch support 306' differs, however, in that it includes two areas 377 where the support is void of material. These areas of the arch support are cut-out in an effort to decrease the weight of the support without comprising its structural integrity. Arch support 306' also differs from support 306 in that it is provided with two downwardly protruding recessions 378 which serve to increase the rigidity of the support in the selected regions (in addition, the depth of the shelf which supports the cushioning component of the sole is increased to rigidify the support). Although support 306' has been presented as an alternative embodiment for illustrative purposes, it should be noted that it is not the preferred embodiment of the invention, as support 306' is too rigid to effectively achieve the objectives of the present invention.

Thus, it should be understood by the skilled artisan that the geometry of the arch support is critical to achieving the objectives of the arch support. Interestingly, however, the general dimensions of the arch support may be varied to allow application of the support to a variety of athletic shoe types so long as the basic curvature of the arch portion of the support remains within a range of 90° to 5°.

Although the athletic shoe of the FIGS. 1–30 includes a novel upper and a novel sole, it should be understood that the upper of the invention may be combined with a sole other than that disclosed herein. For example, the sole construction disclosed in U.S. application Ser. No. 07/748,079, the disclosure of which is incorporated herein by reference, may be combined with the upper of the present invention to form an athletic shoe which is generally lightweight. Conversely, the sole of the present invention may be utilized with an upper of any other construction.

II. The Athletic Shoe of FIGS. 31–40

Figure 31:
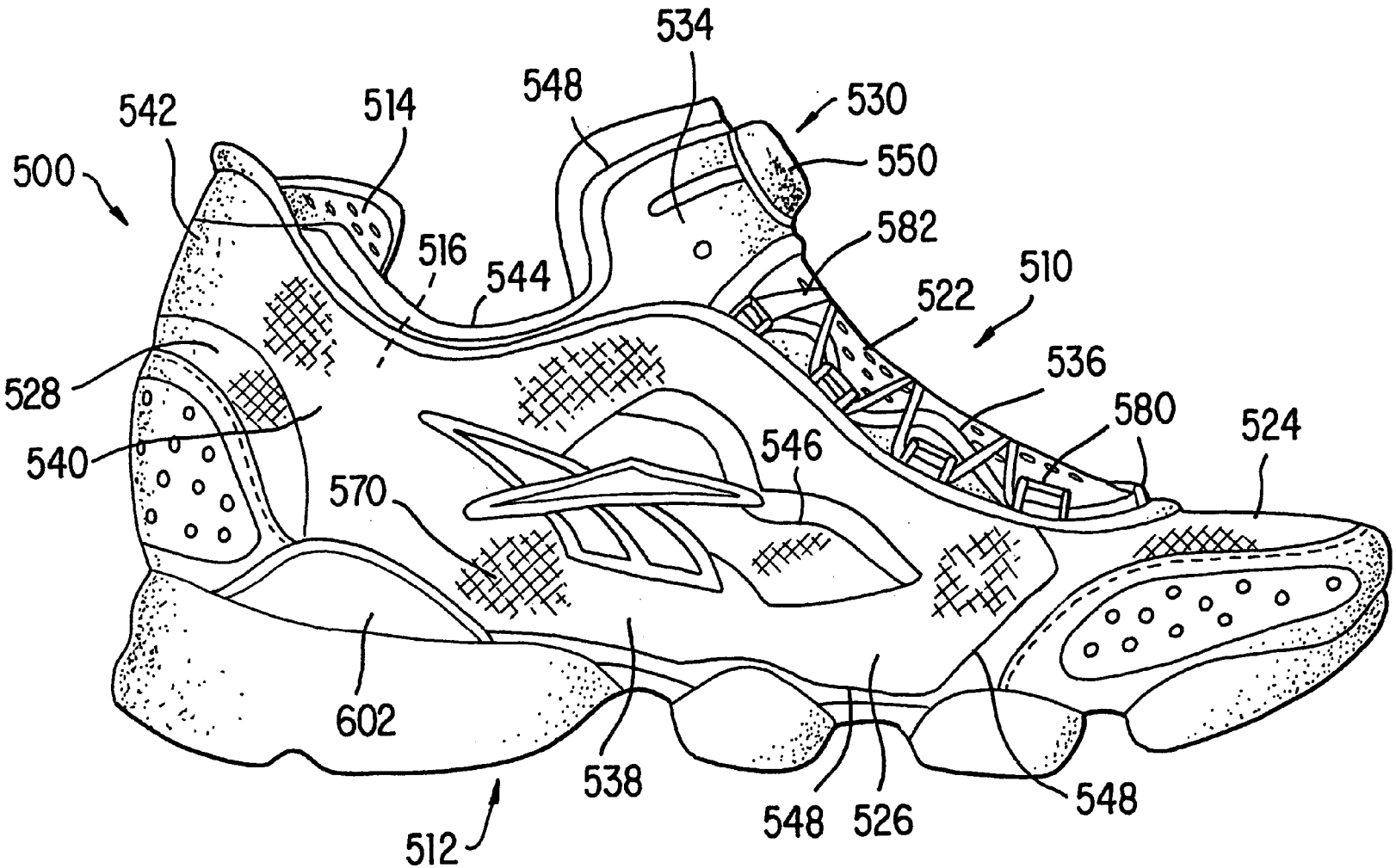
FIG. 31 is a lateral side view of another embodiment of the athletic shoe shown in FIG. 1.
Figure 32:
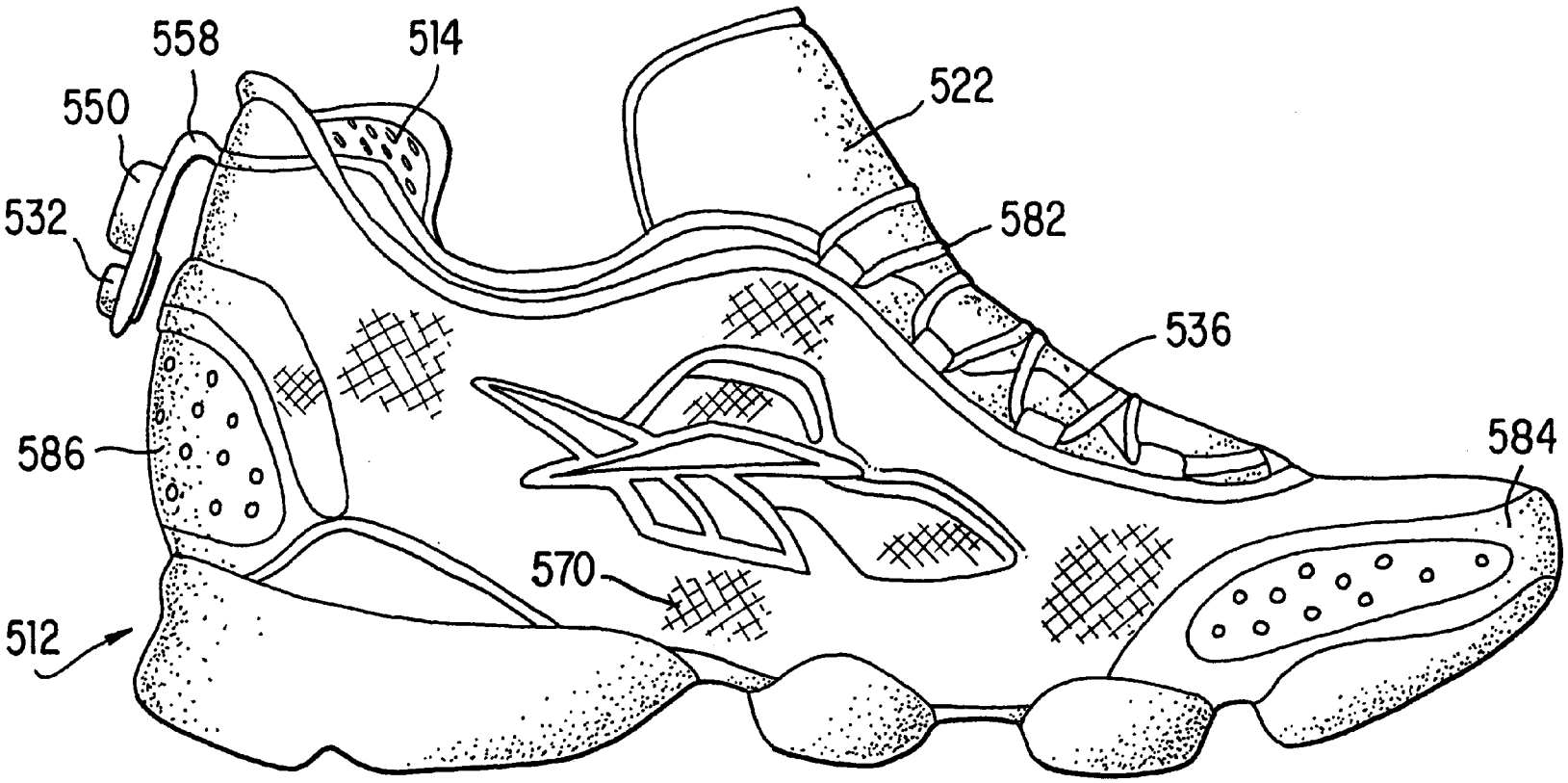
FIG. 32 is a lateral side view of another embodiment of the athletic shoe shown in FIG. 1.

The detailed description of the invention will now turn to the remaining figures of the application. FIGS. 31–38 illustrate another embodiment of an athletic shoe of the present invention. Like athletic shoe 10 of FIGS. 1–29, the athletic shoe of FIGS. 31–38 is structurally minimalistic. Shoe 500 comprises a conformable, lightweight upper 510 and a supportive lightweight sole 512. Although FIGS. 31 and 32 illustrate the lateral side of a shoe for the right foot of a wearer, the principles of the invention are equally applicable to shoes intended for use on the left foot. Furthermore, while a running shoe is illustrated in the Figures, it should be noted that the features of the upper and sole of the invention may be adapted for use with other types of athletic footwear including, but not limited to, tennis shoes, cross-training shoes, and basketball shoes. The upper and sole of athletic shoe 500 will now be described in detail below.

A. The Upper

Like upper 12 of shoe 10, upper 510 of shoe 500 includes an inflatable exoskeleton over a conformable support member. The conformable support member functions as a close-fitting "sleeve" for the upper of the foot and provides a mounting surface for the inflatable exoskeleton of the upper. The inflatable exoskeleton provides customized support to the upper of the foot, while contributing little to the total weight of the shoe. Upper 510 differs from upper 12 in that it comprises an outer member or "overlay" which maintains the exoskeleton in close contact with the foot as the exoskeleton is inflated. The inflatable exoskeleton, conformable support member, and outer member work together to support and protect the upper of the foot, eliminating the need for conventional upper components (such as, interior liners, layered support bands and elastic straps) which contribute to the total weight of the shoe.

1. The Foot Conforming Support Member

Foot conforming support member 514 lies beneath the inflatable exoskeleton to form the innermost surface of upper 510. Foot conforming support member 514 conforms to the contours of the upper portion of the foot. When fully assembled, foot conforming support member 514 covers the upper of the foot and provides a mounting surface for the exoskeleton of the upper. Foot conforming support member 514 may be constructed from the two piece pattern shown in FIGS. 2 and 3. The pattern pieces may be cut from the materials (and assembled in the manner) described above in Section I.A.1. Alternatively, foot conforming support member 514 may be formed from a one-piece or other multiple-piece pattern cut from a material which is durable and stretchable. Regardless of its construction, foot conforming support member 514 should cover at least a portion of the upper of the foot.

As shown in FIGS. 31 and 32, foot conforming support member 514 comprises a tongue 522, a toe portion 524, medial and lateral quarter portions 526, and a heel portion 528. Toe portion 522 covers the top and sides of the toes. Tongue 522 extends from the toe portion of the upper over the instep of the foot. Quarter portions 526 extend from the toe portion of the upper along a portion of the lateral and medial sides of the foot. Heel portion 528 wraps around the sides and back of the heel, accommodating the left and right malleoli and the achilles tendon.

2. The Inflatable Exoskeleton

As mentioned above, upper 510 comprises an inflatable chamber which forms a supportive exoskeleton. Although inflatable chamber 516 is the primary support element of the upper, it accounts for only a small percentage of the total shoe weight. The inflatable chamber of FIG. 31 is essentially identical to the inflatable chamber of FIG. 1 in that it is die cut and welded to define a substantially symmetrical chamber comprising a tongue compartment 534, medial and lateral instep compartments 536, medial and lateral quarter compartments 538, and medial and lateral rearfoot compartments 540. Instead of two ankle compartments, however, inflatable chamber 516 comprises a single heel collar compartment 542 which extends along the back of the heel over the achilles tendon. In areas of the foot where inflatable support is not needed, inflatable chamber 516 is notched or devoid of material to accommodate the structure of the foot and decrease the weight of the shoe. For example, inflatable chamber 516 is notched at 544 to accommodate the left and right malleoli of the ankle. Additionally, chamber 516 is devoid of material in saddle region 546 because inflatable support is not needed in that particular area of the upper.

Inflatable chamber 516 is constructed from the two-layered laminates discussed above in Section I.A.2. The laminates are welded together along a peripheral weld line 548 in accordance with the rf welding technique previously described. Like the peripheral weld line of inflatable chamber 18, portions of peripheral weld line 548 serve as the lasting margin for attaching inflatable chamber 516 to the remainder of shoe 500. The technique for lasting the upper to the remainder of the shoe is discussed in more detail below.

A plurality of circular welds (illustrated, for example, as 74 in FIGS. 6 and 33) are also provided throughout inflatable chamber 516 to control the thickness of the chamber in a particular region. The circular welds should be arranged so that they coincide with the bones and muscles of the foot to provide maximum comfort and support. When the laminates are completely welded together, the peripheral weld lines and circular welds define the inflatable compartments of the chamber (534, 536, 538, 540 and 542).

Instep compartments 536 are minimalistic in nature, as they run only along the medial and lateral edge of the instep. Although the mid-section of the instep region is devoid of inflatable support, the instep compartments effectively push the foot to the rear of the shoe and into the heel region of the upper to provide a secure fit. Similarly, heel collar compartment 542 hugs the foot about the sides and back of the achilles tendon to maintain the heel within the interior of the shoe. Quarter and rearfoot compartments 538, 540 provide support to the rear and side portions of the foot to fill in any remaining gaps between the wearer's foot and the shoe.

In an alternative embodiment of the invention, tongue compartment 534 may be segmented into two overlapping sections. Each section may be provided with a fastening means (for example, VELCRO) for securing shoe 500 on the upper of the foot.

3. The Inflation Mechanism

As previously described, the inflatable chamber of the present invention is provided with an on-board inflation mechanism and a fluid release valve. FIG. 31 illustrates an inflation mechanism 530 comprising a pump 550 disposed on tongue compartment 534 of inflatable chamber 516. Pump 550 is identical to inflation mechanism 200 described in Section I.A.3. of this application. Pump 550 is fluidly attached to inflatable chamber 516 by placing the pump over an appropriately sized aperture provided in the tongue region of the chamber (see Section I.A.3. for a detailed description of the formation and structural components of the inflation mechanism, including check valve 552 and inlet 554). When the pump is not in use ambient air enters the interior of the pump through inlet 554. When the user wishes to inflate chamber 516, the user places his or her thumb or finger over the inlet and depresses top surface 556 into the interior of the pump. As the top surface is depressed, fluid (air) within the interior of the pump is forced through the outlet and into the fluid passageways of inflatable chamber 516. During the pressure stroke, fluid is prevented from escaping to the atmosphere by the user's digit which covers the inlet. As the domed top surface returns to its original shape, ambient air flows into the interior of the pump through inlet 554. Fluid already within the confines of the chamber is prevented from flowing back into the pump by check valve 552. Check valve 552 takes the same form as that described above with respect to FIG. 13. The user continues to depress the top surface of the pump until the desired pressure is obtained within the chamber.

Figure 33:
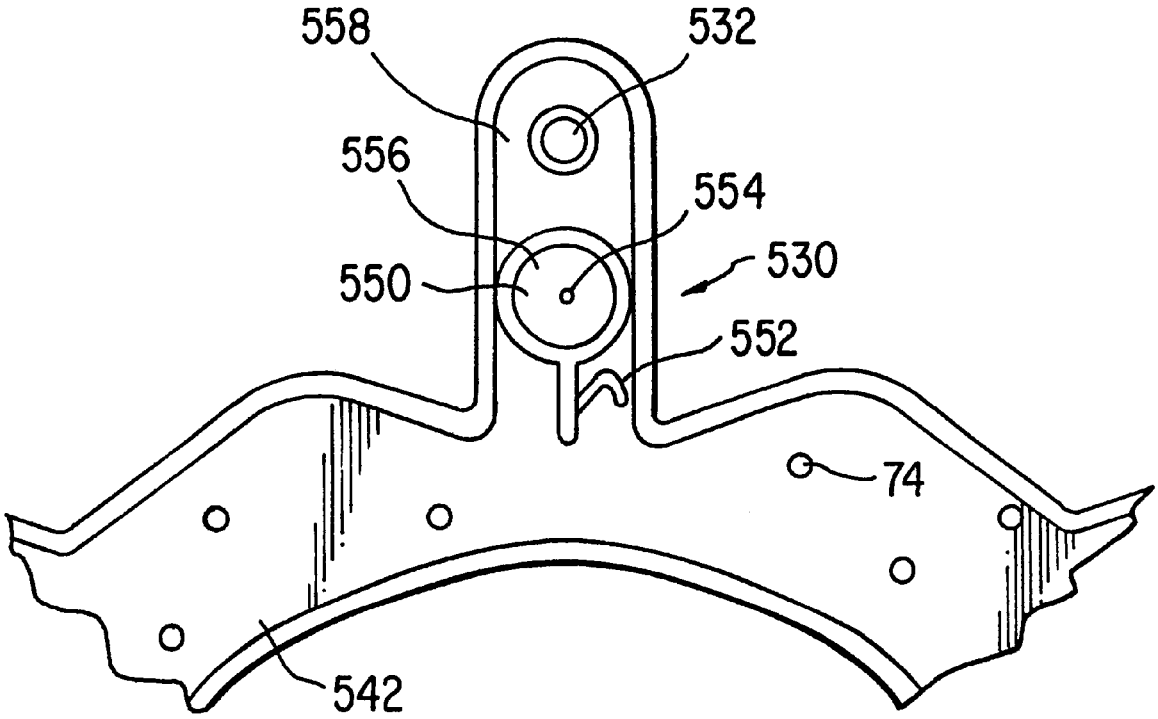
FIG. 33 is a top plan view of a portion of the inflatable chamber of the athletic shoe shown in FIG. 32.

While inflation mechanism 530 of FIG. 31 has been illustrated as being disposed on tongue compartment 534, this is not to say that the inflation mechanism cannot be disposed in any other location. As illustrated in FIG. 32, inflation mechanism 530 may be disposed on a tab 558 which extends from the upper edge of heel compartment 542 of inflatable chamber 516. Tab 558 is an integral part of inflatable chamber 516 and is in fluid communication with all compartments of the chamber. FIG. 33 illustrates a portion of inflatable chamber 516 which includes tab 558 and heel compartment 541. As shown in this figure, inflation mechanism 530 is welded to innermost laminate 560 of inflatable chamber 516 so that it may be easily accessed by the user when the chamber is to be inflated. If the inflation mechanism is positioned on the outermost laminate of the chamber, the user will need to bend (hyperextend) his or her hand and wrist into an awkward position in order to access the top surface of the pump. Such a position is not ergonomic and would compromise the user's ability to form a seal over inlet 554 of the pump. As shown in FIGS. 32 and 33, tab 558 is movable between an upright active condition (FIG. 33) and a stored condition (FIG. 32). When the user wishes to inflate chamber 516, he or she lifts the tab to the upright condition and depresses the domed top surface of the pump. Because the inflation mechanism is attached to the innermost laminate of inflatable chamber 516, the pump is easily accessed by the user. When the chamber has been inflated to the desired pressure, the tab is folded down into the stored condition shown in FIG. 32. Tab 558 is maintained in the stored condition by a hook and loop type fastener 561 (such as VELCRO) or any other type of fastener. A first element 562 of fastener 561 is disposed on the back side of tab 558 (that is, outermost laminate 564 of inflatable chamber 516), while a second element 566 of fastener 561 is attached to the heel of shoe 500. Since the pump of the shoe shown in FIG. 32 is disposed on tab 558 in the heel region of the shoe, tongue compartment 534 has been eliminated.

4. The Fluid Release Mechanism

Fluid is released from chamber 516 using the fluid release mechanism described in connection with FIGS. 14–17 of this application. Fluid release mechanism 532 is fitted within an aperture of inflatable chamber 516 to enable venting or deflation of the chamber. On the shoe of FIG. 31, fluid release mechanism 532 is positioned on the medial side of inflation mechanism 530 (not shown). In FIG. 32, fluid release mechanism 532 is positioned adjacent inflation mechanism 530 on tab 558. Although the fluid release mechanism is shown below the pump when the tab is in the stored condition, it should be noted that the fluid release mechanism may be positioned above the inflation mechanism or in any other location which is in fluid communication with the inflatable chamber. The fluid release mechanism is preferably welded to the chamber in a position where it will not interfere with the user's activity.

Figure 18:
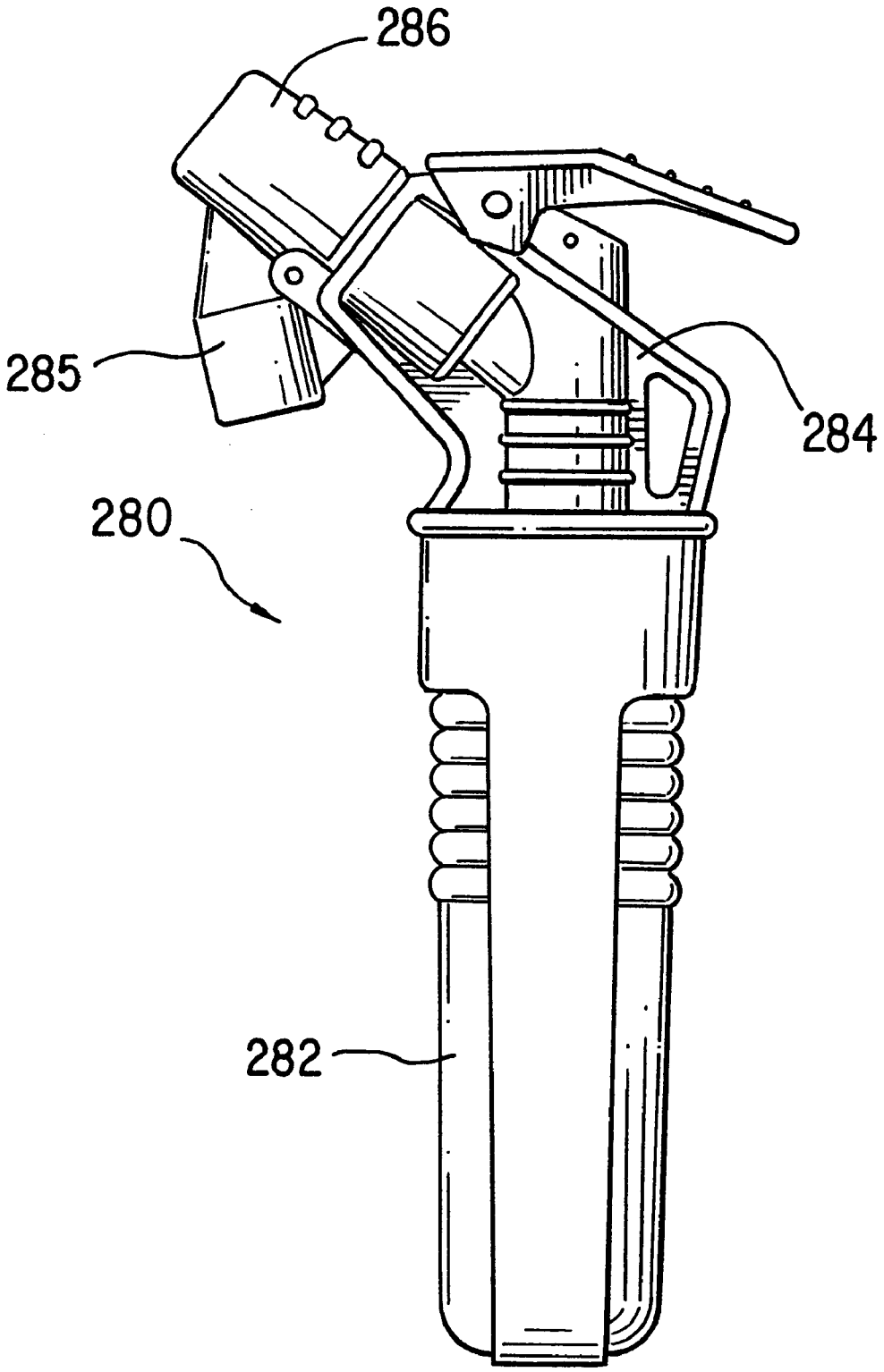
FIG. 18 is a side elevational view of an off-board inflation mechanism.

As shown in FIGS. 15–17, the fluid release mechanism of the present invention includes a cover 250 which mates with a pressurized gas inflation device 280 shown in FIG. 18. If desired, this cover may be employed on fluid release mechanism 532 of shoe 500 or it may be eliminated or substituted with another cover which protects the components of the fluid release mechanism, but does not serve as means for coupling the pressurized gas inflation device to the inflatable chamber of the shoe. If inflatable chamber 516 is not intended to be inflated by inflation device 280, then the specifications of the chamber may be altered to reduce the manufacturing costs of the shoe without comprising the integrity of the chamber. More particularly, the thickness of the TPU film may be reduced to 10 mils, and the stretch component of the fabric lamina may be increased, as pressurization of the chamber by pump 550 is significantly less than that by inflation device 280 (approximately 4–5 psi versus 17.5 psi). As the thickness of the TPU film decreases, so does the cost to manufacture the shoe.

5. The Outer Member or "Overlay"

As shown in FIGS. 31 and 32, shoe 500 includes an outer member or "overlay" 570 which extends over inflatable chamber 516 from toe portion 524 to heel portion 528. Overlay 570 is provided to pull the inflatable chamber of shoe 500 into close contact with the user's foot as the chamber is inflated. As inflatable chamber 516 is inflated, the compartments of the chamber tend bulge away from the upper surface of the foot, making only tangential contact. Overlay 570 inhibits or restricts this outward bulging, bringing each compartment of the chamber into intimate contact with the contours of the wearer's foot.

With reference again to FIGS. 31 and 32, overlay 570 is a fabric or material having an upper edge 574 and a lower edge 576. Upper edge 574 generally follows the line of inflatable chamber 516 on the side medial and lateral sides of upper 510. Upper edge 574 is provided with piping 572 which extends from the heel region to the toe of the shoe. A plurality of loops 580 extend from piping 572 of upper edge 574 in the instep area of the upper around the tongue of the shoe. Loops 580 receive a lace 582 which draws the edges of overlay 570 over the upper of the foot when the lace is tightened and secured. Lower edge 576 of overlay 570 is attached to the bottom of upper 510 when upper 510 is lasted.

In order to inhibit or restrict bulging of inflatable chamber 516 away from the wearer's foot, overlay 570 should have little to no stretch. In a preferred embodiment of the invention, overlay 570 is a mesh fabric which allows the wearer to visualize the support element (that is, the inflatable exoskeleton) through the overlay of the shoe. Two mesh fabrics which allow visualization of the inflatable exoskeleton are available from Gehring and TDW under product nos. YM3328 and 9–64, respectively. It should be noted, however, that both fabrics have more stretch than desired. The Gehring fabric has a "pore" size of 3.6×1.5 mm, while the TDW fabric has a pore size of 5.0×2.5 mm. The pores of the fabric allow the wearer to visualize the inflatable technology, but do not interfere with the ability of the overlay to inhibit or restrict outward bulging of inflatable chamber 516. If the pore size is increased, than the stretch of the fabric should be decreased.

Although a mesh fabric is illustrated in FIGS. 31 and 32, other materials may be used to form overlay 570. In an alternate embodiment of the invention, overlay 570 may be a sheet of clear or transparent TPU which is stitched to the upper of the shoe, pulled down over inflatable chamber 516 and attached to the bottom of the upper. If overlay 570 is a TPU film, the film should be approximately 5–10 mils thick.

It should be noted at this point that straps 98, 100 and 106 of shoe 10 (illustrated in FIGS. 1 and 7, for example) are not required because overlay 570 functions to pull inflatable chamber 516 over the outer surface of the foot, while preventing outward bulging of the chamber compartments.

While particular materials have been described for overlay 570, any other material or fabric which allows visualization of inflatable chamber 516, but inhibits outward bulging, is suitable for accomplishing the objectives of the invention.

6. Assembling the Upper of the Athletic Shoe

Figure 12:
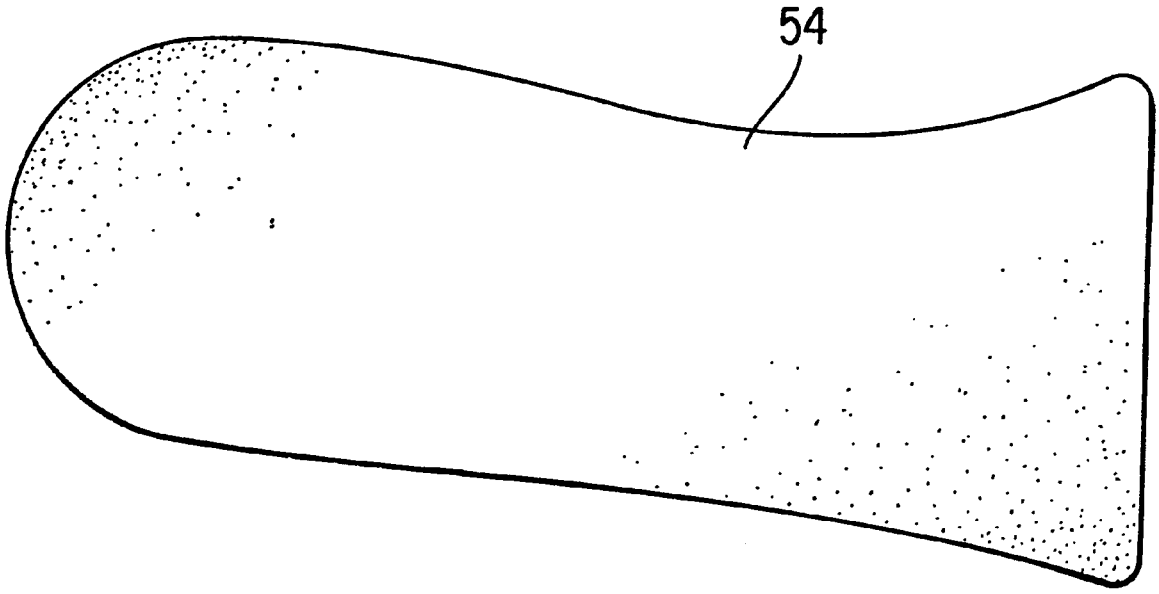
FIG. 12 is a top plan view of an insole.

After constructing foot conforming support member 514, a partial slip sock (not shown) is stitched to the lasting margin of the pattern piece(s). Inflatable chamber 516 is placed on and stitched to foot conforming support member 514 along the portion of peripheral weld line 548 which extends along sole 512 of shoe 500. Overlay 570 is then stitched to inflatable chamber 516 along the portion of peripheral weld line 548 which extends along the tongue, instep and heel regions of the upper. A toe cap 584 and a heel counter 586 (formed of leather or other suitable material) is then stitched to the toe and heel portions of overlay 570, respectively. To complete assembly of upper 510, a partial insole board, such as that shown in FIG. 12, is attached to an appropriately sized last. The stitched upper is placed over the insole board and attached to the last. The lasting margins (that is, the lower edges) of foot conforming support member 514, inflatable chamber 516, and overlay 570 are pulled up over and cemented to the edges of the insole board to form a complete upper. At this point, the upper is ready to be attached to the sole of the shoe.

B. Sole

Having described the structure and function of upper 510, attention will now be directed to the sole of the shoe shown in FIGS. 31–38. As stated earlier in this application, the sole of an athletic shoe serves three purposes: cushioning, protection and support. Any one of these functions may be accomplished by various materials or elements. However, such elements tend to increase the total weight of the shoe. To achieve a sole which is lightweight, the components thereof must be structured in a minimalistic fashion from materials which are functionally efficient. The sole of shoe 500 accomplishes this objective.

Sole 512 of shoe 500 uses a combined midsole/outsole and a rigid plate to minimize the use of conventional sole materials to reduce the weight of the shoe. The components of the sole are configured and arranged to work with the bio-mechanics of the foot to create a sole for a shoe which is functionally efficient, yet minimal in the structural sense.

Sole 512 generally underlies and follows the outer profile of the foot to provide protection, cushioning and support. Sole 512 includes a carrier element 590, a forefoot unit 592, and a heel unit 594.

1. The Carrier Element

Figure 34:
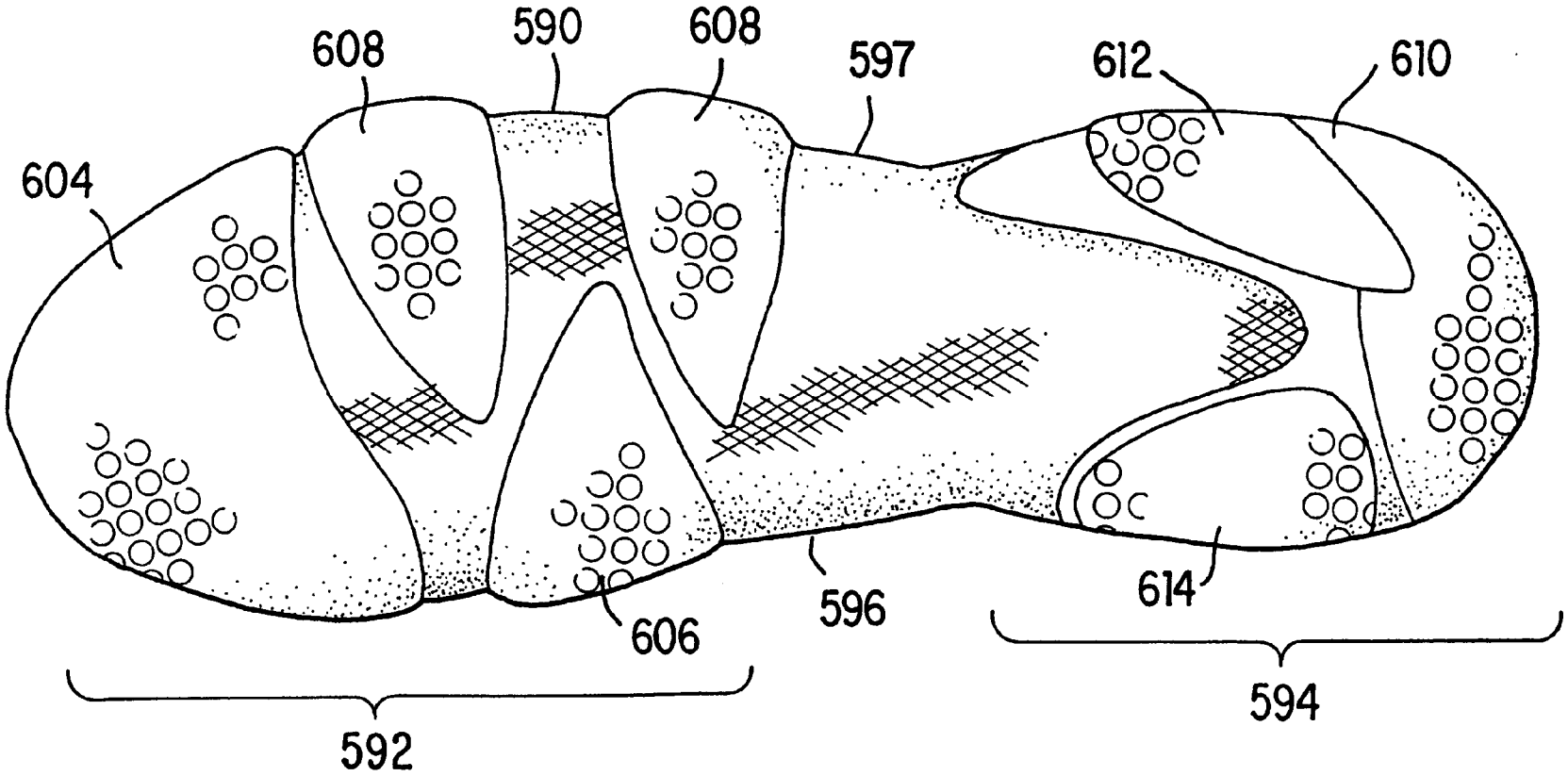
FIG. 34 is a bottom plan view of the sole of the athletic shoe shown in FIG. 32.
Figure 35:
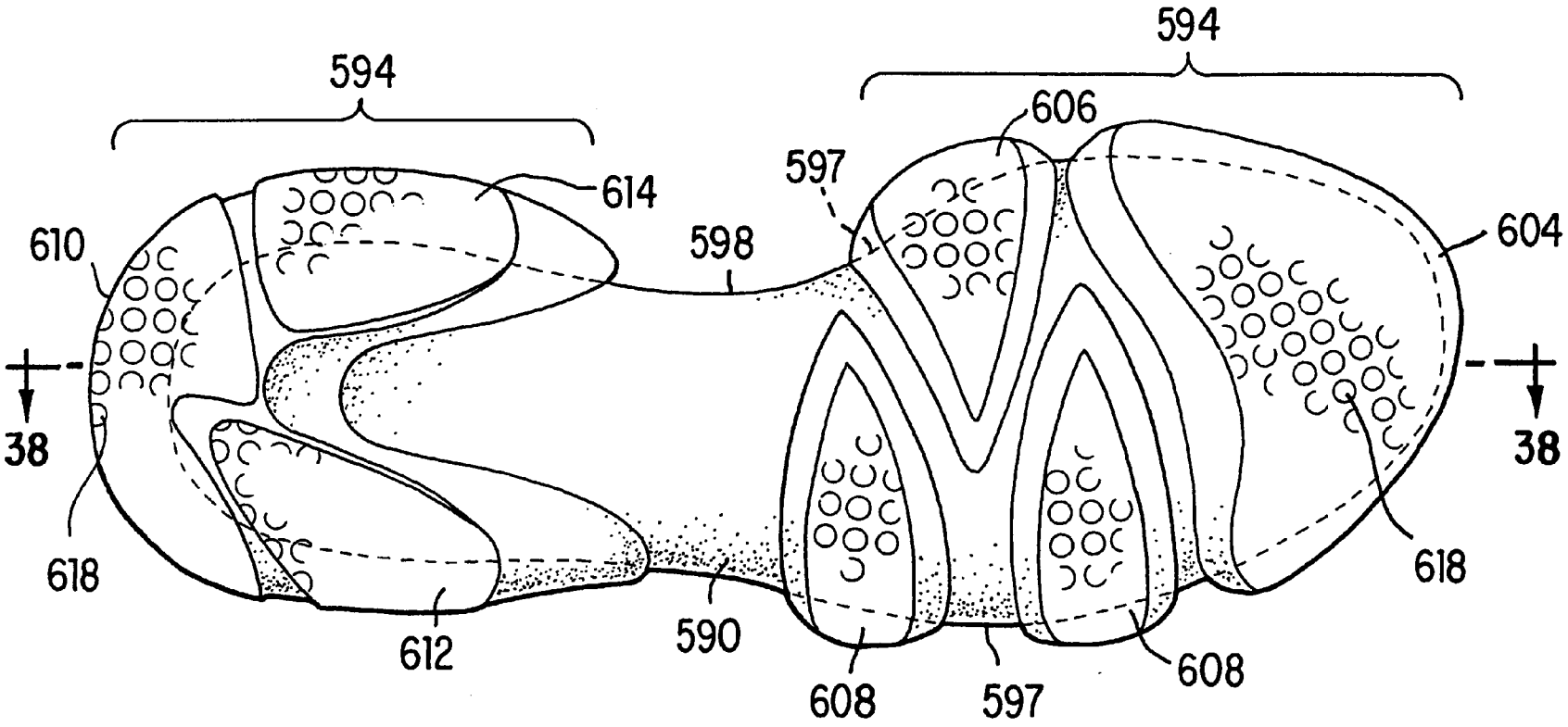
FIG. 35 is another bottom plan view of the sole of the athletic shoe shown in FIG. 32.
Figure 36:
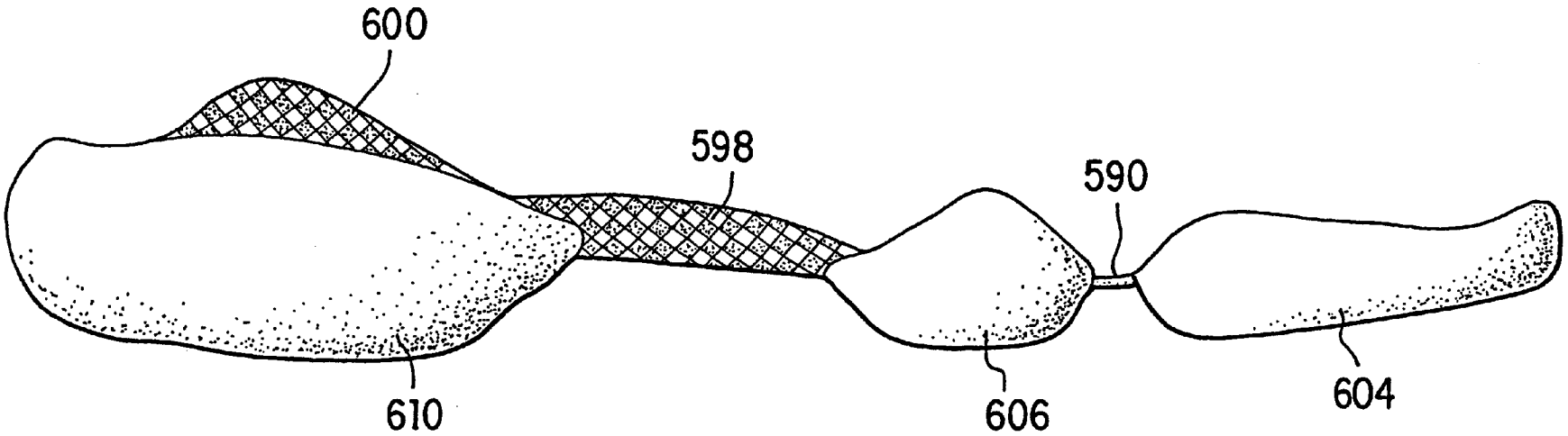
FIG. 36 is a medial side view thereof.

As shown in FIGS. 34 and 35, carrier element 590 spans the entire length and width of the foot. Like the arch piece of shoe 10 (shown in FIG. 19), carrier element 590 comprises a rigid support or plate. By using a rigid support in the arch area of the shoe, a considerable amount of midsole and outsole material may be eliminated. Carrier element 590 extends across the entire width of the shoe to define a medial edge 596 and a lateral edge 597. In the arch region of carrier element 590, medial edge 596 curves upwardly to conform to and support the arch of the wearer (FIG. 36). At arch curve 598, carrier element 590 is rigid and resistant to flex, as the curve along the medial edge has an I-beam effect which strengthens the carrier element to rigidify the same. Resistance to flex is important in this region because the arch of the foot must be rigidly supported during each phase of the gait cycle.

In the toe region of the sole, carrier element 590 is substantially flat to facilitate flexing of the foot and to enable distribution of impact forces across the metatarsal heads of the foot. At the very end of the toe region, carrier element 590 comes to a rounded point to assist in the toe-off portion of the gait cycle.

Carrier element 590 is substantially flat in the heel region of the sole. However, the medial and lateral edges of carrier element 590 wrap up onto the sides of the heel to form a medial heel stabilizer 600 (FIG. 36) and a lateral heel stabilizer 602 (FIG. 31). Medial and lateral heel stabilizers 600, 602 function to stabilize the foot to prevent roll-over of the foot (either pronation or supination) during the gait cycle.

Like arch support 306 of shoe 10, carrier element 590 is formed from a woven carbon/glass composite. The composite is preferably 30/1000 inch, but may be as thick as 50/1000 inch. In the preferred embodiment, the carbon material of the composite runs in the anterior-posterior direction of the arch, while the glass composite is oriented in the medial-lateral direction. Thus, the carrier element provides torsional stability across the width of the shoe, but allows the shoe to flex from toe to heel. Using a 2×2 twill weave of 50% carbon and 50% glass, an epoxy of acrylic resin is poured over at least one surface of the carrier element. A suitable composite for the carrier element of sole 514 is manufactured by Hexcel Corporation, Dublin, Calif., under product no. PPM-39. Other materials for use in making carrier element 590 include a carbon/aramid KEVLAR/glass composite. NUCREL, a resin available from E.I. DuPont de Nemours, may be used to coat the carrier element.

In addition to providing support to the arch of the foot, carrier element 590 serves as a mounting platform for mounting the cushioning elements of the sole to the shoe. Cushioning is provided to the foot by a forefoot unit 592 and a heel unit 594 discussed in more detail below.

2. The Forefoot Unit

Figure 37:
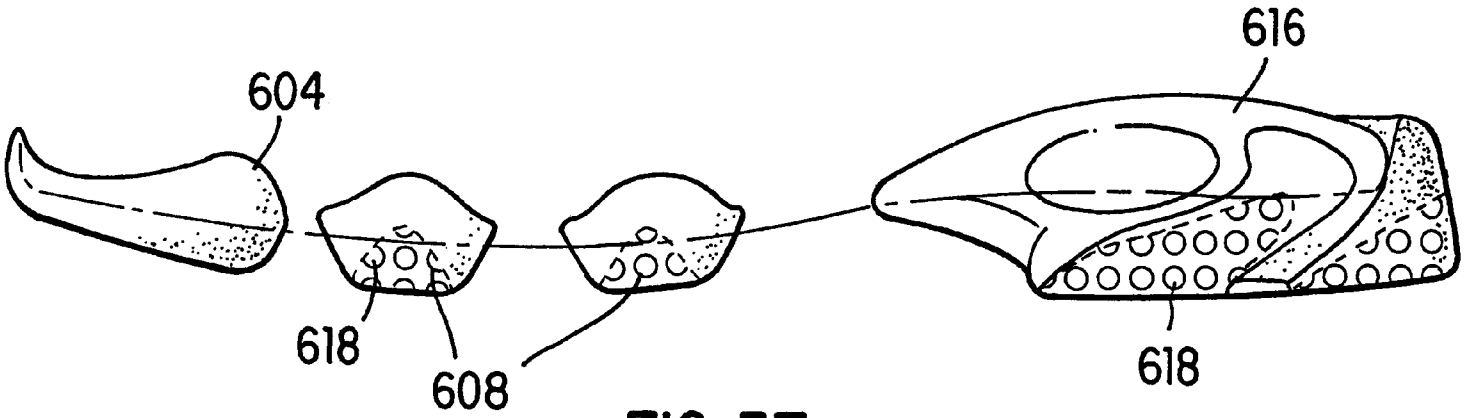
FIG. 37 is a lateral side view thereof.
Figure 38:
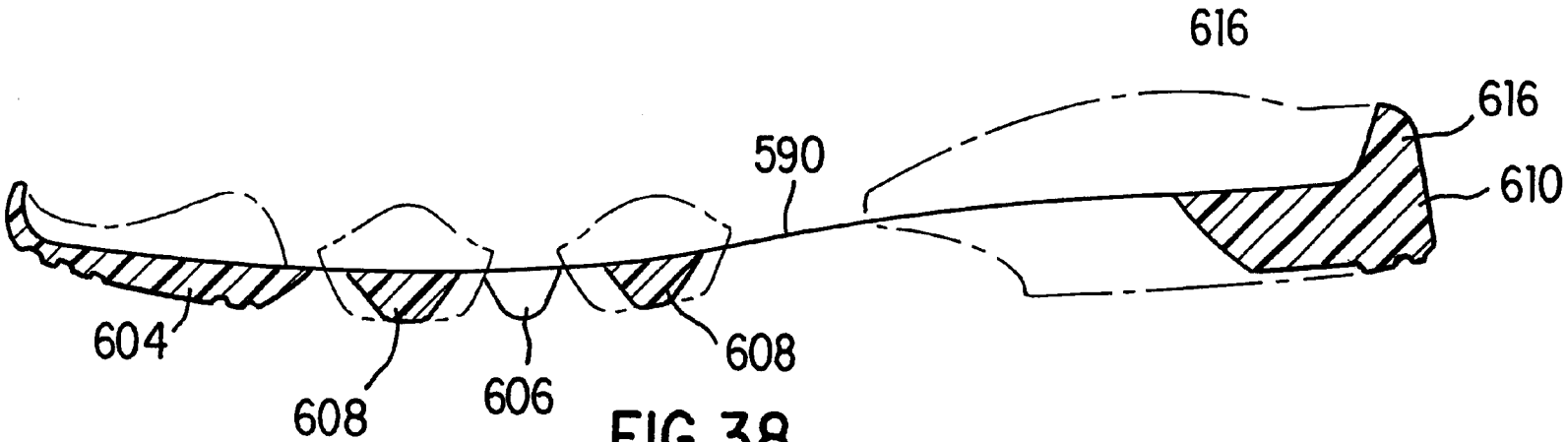
FIG. 38 is a cross sectional view of the sole taken along line III—III in FIG. 35.

Forefoot unit 592 comprises a toe component 604, a medial forefoot component 606, and two lateral forefoot components 608. Components 604, 606 and 608 are arranged in the forefoot section of the sole to provide cushioning and support only where needed. After heel strike, the foot of a runner with a correct gait rolls forward along the lateral edge of the shoe to the forefoot section. In the forefoot section, the foot rolls across the ball to the medial side of the shoe. The foot then continues to roll forward onto the toes, where the runner eventually toes off. With this in mind, two components 608 are positioned along the lateral edge of the forefoot section, while one component 606 is positioned along the medial edge. A toe component 604 lies beneath the metatarsal heads of the foot to cushion and distribute impact forces. As shown in FIGS. 37 and 38 each component wraps up onto the sides of the shoe to provide stability and to assist in adhesion of the sole to the upper.

3. The Heel Component

A heel component 610 is provided in the heel region of the sole. Heel component 610 is substantially u-shaped and defines a lateral leg 612 and a medial leg 614. Lateral leg 612 extends along the lateral edge of the shoe, while medial leg 614 extends along the medial edge of the shoe. Lateral leg 612 is slightly longer than medial leg 614 to provide cushioning and support to the foot as it proceeds through the gait cycle along the lateral edge of the shoe to the forefoot section of the sole. The upper edge of heel component 610 wraps up onto upper 510 to form a heel cup 616. Heel cup 616 supports and stabilizes the heel of the foot and facilitates bonding of the sole to the upper.

4. The Component Material

As mentioned above, sole 512 uses a combined midsole/outsole material to reduce the weight of the shoe. In a preferred embodiment, components 604, 606, 608 and 610 are molded from a compound comprising a cushioning foam (for example, polyurethane or ethyl vinyl acetate) and an abrasion resistant rubber. Such a compound is available from Eclipse Polymers Co. Ltd. under the trademark ECLIPSE 3D. Components 604, 606, 608 and 610 may be injection molded and bonded to the bottom of carrier element 590 or they may be chemically bonded to the carrier element using a direct attach technique. In either event, the bottom surface of each component may be molded with a plurality of tread elements to increase the traction of the sole. As shown in FIGS. 35 and 37, tread elements 618 may comprise dimples. However, tread elements 618 may take the form of sipes, lugs or other appropriately dimensioned projections:

After bonding components 604, 606, 608 and 610 to carrier element 590, an adhesive is applied to the top surface of the carrier element to bond the sole to the upper of the shoe.

5. Alternate Embodiment of Sole

Figure 39:
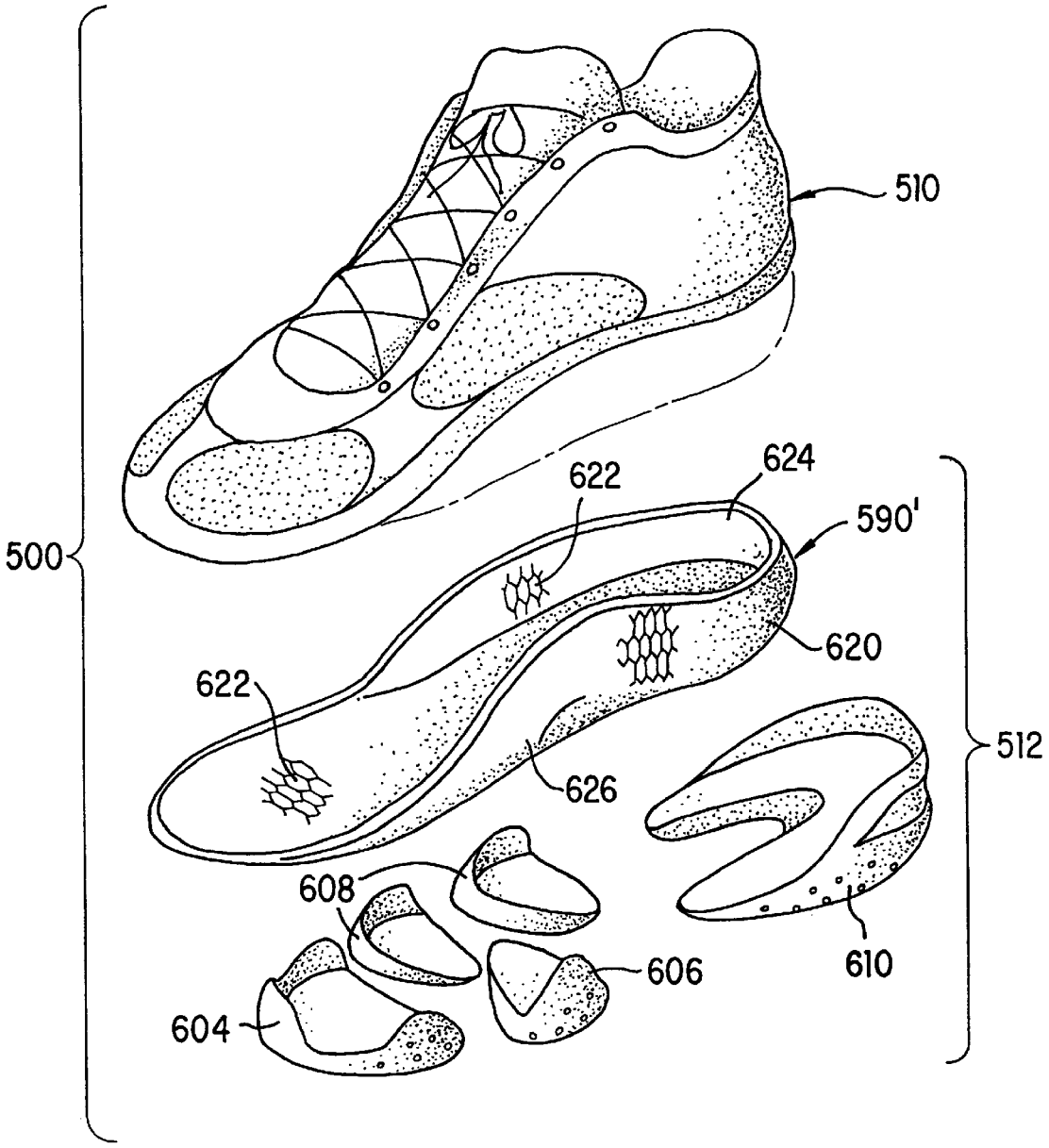
FIG. 39 is an exploded perspective view of an alternate embodiment of the sole of the preset invention.

In an alternate embodiment of the invention, carrier element 590' of sole 512 is formed from a sheet of honeycomb material 620. The honeycomb material includes a plurality of cells 622 which provide cushioning and support to the foot of the wearer. To form carrier element 590', the upper film of the honeycomb sheet is removed and replaced with a thermal plastic elastomer (for example, PTGE). The honeycomb sheet is then placed over an appropriately sized shoe last and heated to approximately 300° F. As the honeycomb sheet is heated, it conforms to the shape and contour of the shoe last. The sheet is removed from the last after it has cured. The honeycomb sheet is somewhat rigid in that it maintains the shape and contour of the shoe last. As shown in FIG. 39, carrier element 590' differs from carrier element 590 in that it includes a continuous heel wrap 624 which wraps up onto the upper of shoe 500 to stabilize the heel and rearfoot regions of the foot. Like the carbon glass carrier element described above, carrier element 590' includes an arch support 626 (FIG. 39) which conforms to the contours of the arch to provide rigid, non-yielding support.

Figure 40:
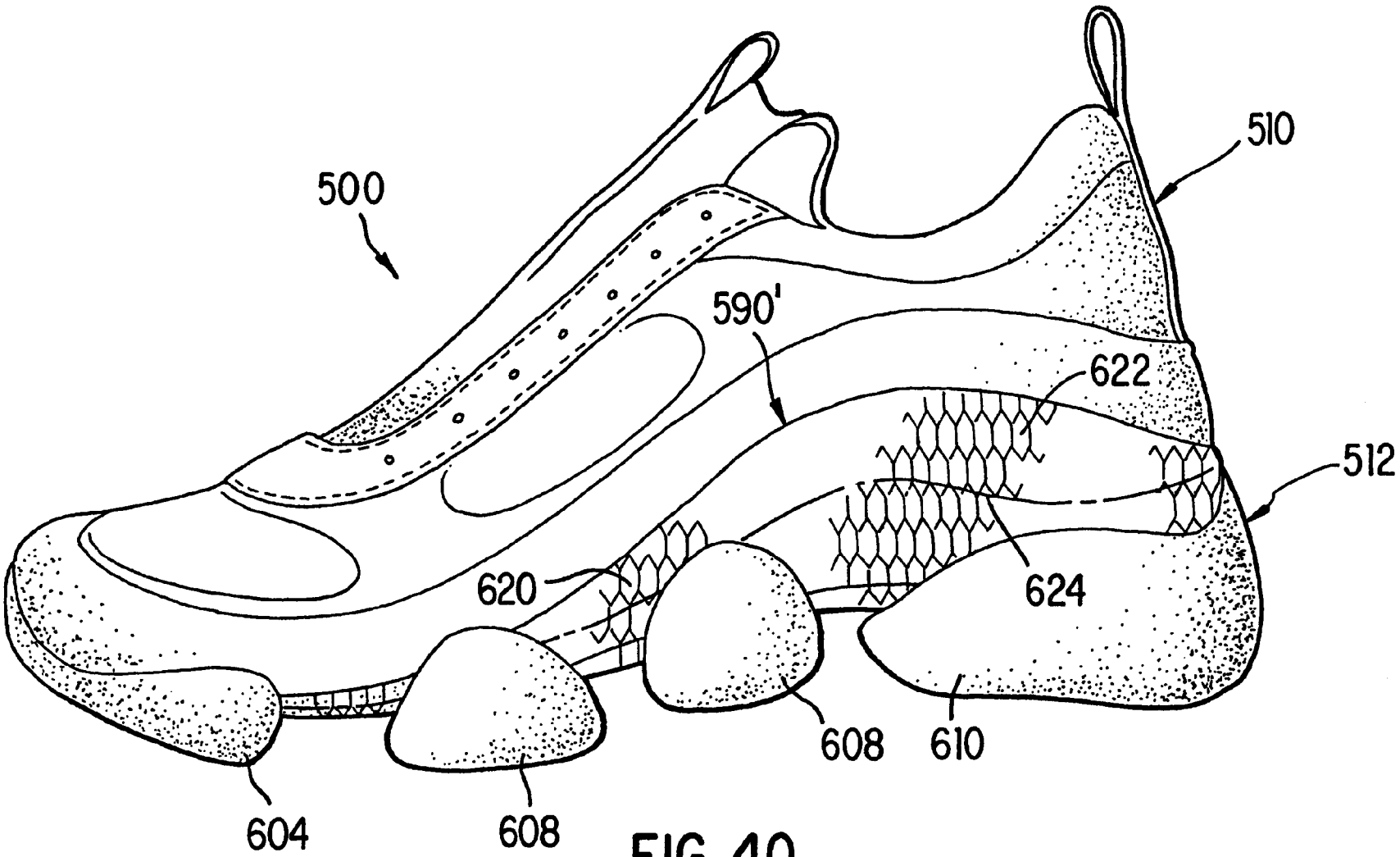
FIG. 40 is a right side elevational view of an athletic shoe comprising the sole of FIG. 39.

Components 604, 606, 608 and 610 may be attached to carrier element 590' by a mechanical bond or by a chemical bond using a direct attach technique. Sole 512 is attached to upper 510 after attaching the component parts to carrier element 590'. As shown in FIG. 40, carrier element 590' efficiently provides cushioning and support to the sole, arch and sides of the wearer's foot. Although a different upper is shown in FIG. 40, this is not to say that the sole of FIGS. 39 and 40 could not be used with the upper of FIGS. 31–38 or any other upper. Indeed, the upper and sole of the present invention may be interchanged with any other construction.

In summary, the sole of FIGS. 31–40 is lightweight, provides better flexibility and is easier to assemble than conventional midsole and outsoles. In addition, sole 512 advantageously reduces mold costs due to the fact that the midsole/outsole components of the sole can be used over three (3) half sizes versus the industry standard of one mold for every half size. Furthermore, the components are molded from a combined midsole/outsole material which eliminates the need for a separate outsole mold.

While a combined midsole/outsole material has been described, this is not to say that the components of sole 512 cannot be molded from conventional midsole and outsole materials. Indeed, components 604, 606, 608 and 610 can be molded from the same materials used to mold the heel and forefoot pieces shown in FIGS. 19–25. The components may be bonded to carrier element 590 in the manner previously described.

In addition, it is envisioned that carrier element 590 may be used in conjunction with a mechanical midsole as opposed to a foam. For example, an abrasion resistant bladder having a plurality of interconnected passageways may be attached to the bottom of the carrier element to provide a cushioning shoe sole. Such a bladder is disclosed in co-pending U.S. application Ser. No. 08/697,895 filed Sep. 3, 1996. The disclosure of this application is incorporated herein by reference.

The foregoing description of the preferred embodiments of the invention have been presented for the purposes of illustration and description only. It is not intended to be exhaustive or to limit the invention to the precise form disclosed, and obviously many possible modifications and variations are possible in light of the above teachings.

What is claimed is:

1. An athletic shoe having a forefoot region and a heel region, comprising:

an upper; and a sole, said sole comprising:

a rigid carrier element having an upper surface disposed in a facing relationship with said upper of the shoe, a lower surface, and a peripheral edge;

a forefoot component mounted to said lower surface of said carrier element in the forefoot region of the shoe; and a heel component mounted to said lower surface of said carrier element in the heel region of the shoe;

wherein said forefoot component is mounted to said lower surface of said carrier element such that a portion of said forefoot component wraps up onto a portion of the upper of the shoe.

2. An athletic shoe having a forefoot region and a heel region, comprising:

an upper; and a sole, said sole comprising a rigid carrier element having an upper surface disposed in a facing relationship with said upper of the shoe, a lower surface, and a peripheral edge, a plurality of separate and distinct forefoot components mounted to said lower surface of said carrier element in the forefoot region of the shoe and a heel component mounted to said lower surface of said carrier element in the heel region of the shoe;

wherein said plurality of separate and distinct forefoot components comprises a toe component, a first lateral component, a second lateral component, and a medial component, and each one of said plurality of separate and distinct forefoot components is mounted to said lower surface of said carrier element such that a portion of each one of said components extends to said peripheral edge of said carrier element and wraps up onto a portion of the upper of the shoe.

3. The athletic shoe of claim 2, wherein said carrier element is formed from a carbon and glass composite.

4. The athletic shoe of claim 3, wherein each one of said plurality of separate and distinct forefoot components is molded from a foam which provides cushioning and is abrasion resistant.

5. The athletic shoe of claim 4, wherein each one of said plurality of separate and distinct forefoot components is injection molded.

6. The athletic shoe of claim 5, wherein each one of said plurality of separate and distinct forefoot components comprises traction elements.

7. The athletic shoe of claim 2, wherein said heel component is formed from a foam which provides cushioning and is abrasion resistant.

8. The athletic shoe of claim 2, wherein said carrier element defines an arch region, a forefoot region and a heel region.

9. The athletic shoe of claim 8, wherein said arch region of said carrier element curves upwardly to support the arch of a wearer's foot.

10. The athletic shoe of claim 9, wherein said carrier element further comprises a heel stabilizer.

11. The athletic shoe of claim 9, wherein said carrier element is a composite of woven carbon and glass fibers and wherein said carrier element is woven such that said arch region of said carrier element is less flexible than said forefoot region.

12. The athletic shoe of claim 2, wherein said carrier element comprises a sheet of honeycomb material.

13. An athletic shoe having a forefoot region and a heel region, comprising:

an upper; and a sole, said sole comprising a carrier element having an upper surface disposed in a facing relationship with said upper of the shoe, a lower surface and a peripheral edge, a forefoot unit mounted to said lower surface of said carrier element in the forefoot region of the shoe and a heel unit mounted to said lower surface of said carrier element in the heel region of the shoe;

wherein said carrier element comprises a sheet of honeycomb material and said forefoot and heel units are mounted to said lower surface of said carrier element such that a portion of each of said forefoot and heel units extends to said peripheral edge of said carrier element and wraps up onto the upper of the shoe.

14. The athletic shoe of claim 13, wherein said forefoot unit comprises a toe component, two lateral components, and a medial component.

15. The athletic shoe of claim 13, wherein said forefoot and heel units are molded from a foam which provides cushioning and is abrasion resistant.

16. The athletic shoe of claim 13, wherein said honeycomb material comprises a thermal plastic elastomer.

17. The athletic shoe of claim 16, wherein said carrier element is formed by placing said sheet of honeycomb material on an appropriately sized shoe last and by heating said sheet of honeycomb material to a temperature of 300° F.

* * * * *